US010118398B2

(12) United States Patent
Nishimaki et al.

(10) Patent No.: US 10,118,398 B2
(45) **Date of Patent: *Nov. 6, 2018**

(54) PLUG MEMBER AND LIQUID CONTAINER UNIT

(71) Applicant: Seiko Epson Corporation, Tokyo (JP)

(72) Inventors: Koji Nishimaki, Matsumoto (JP); Naomi Kimura, Okaya (JP); Shoma Kudo, Shiojiri (JP); Shoichi Ishizawa, Yamagata-mura (JP); Yoshiyuki Tanaka, Matsumoto (JP); Koji Kawai, Shiojiri (JP); Makoto Omuro, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/633,209

(22) Filed: Jun. 26, 2017

(65) Prior Publication Data

US 2017/0291423 A1 Oct. 12, 2017

Related U.S. Application Data

(63) Continuation of application No. 15/066,547, filed on Mar. 10, 2016, now Pat. No. 9,707,768.

(30) Foreign Application Priority Data

Mar. 12, 2015 (JP) ..... 2015-049564

(51) Int. Cl.
*B41J 2/175* (2006.01)
*B65D 41/00* (2006.01)
(Continued)

(52) U.S. Cl.
CPC ..... *B41J 2/17536* (2013.01); *B41J 2/1752* (2013.01); *B41J 2/1754* (2013.01);
(Continued)

(58) Field of Classification Search
CPC .. B41J 2/17509; B41J 2/1752; B41J 2/17523; B41J 2/17536; B41J 2/17543;
(Continued)

(56) References Cited

U.S. PATENT DOCUMENTS 5,038,959 A * 8/1991 Patel ..... A47G 19/14 220/303
5,454,805 A * 10/1995 Brony ..... A61J 1/2096 215/308
(Continued)

FOREIGN PATENT DOCUMENTS

JP S50-143953 U 11/1975
JP S58-052053 A 3/1983
(Continued)

OTHER PUBLICATIONS

Non-Final Office Action dated Oct. 13, 2016 in U.S. Appl. No. 15/066,547.

*Primary Examiner* — Anh T. N. Vo
(74) *Attorney, Agent, or Firm* — Foley & Lardner LLP

(57) ABSTRACT

There is provided a plug member that is detachably mounted to a liquid inlet to close the liquid inlet. The plug member comprises a sealing part configured to close the liquid inlet, such that at least part of the sealing part is inserted in the liquid inlet; and a cover part arranged around at least part of circumference of the sealing part.

7 Claims, 14 Drawing Sheets

(51) Int. Cl.
*B65D 41/02* (2006.01)
*B65D 39/16* (2006.01)
*B41J 29/13* (2006.01)

(52) U.S. Cl.
CPC ..... *B41J 2/17509* (2013.01); *B41J 2/17523* (2013.01); *B41J 2/17543* (2013.01); *B41J 2/17553* (2013.01); *B41J 29/13* (2013.01); *B65D 39/16* (2013.01); *B65D 41/005* (2013.01); *B65D 41/023* (2013.01)

(58) Field of Classification Search
CPC .. B41J 2/175452; B41J 2/17553; B41J 29/13; B65D 41/005; B65D 41/023
See application file for complete search history.

(56) References Cited

U.S. PATENT DOCUMENTS

| | | | | |
|---|---|---|---|---|
| 5,721,576 | A | 2/1998 | Barinaga | |
| 6,314,866 | B1 | 11/2001 | Melton | |
| 7,101,022 | B2 | 9/2006 | Mui et al. | |
| 7,175,264 | B2 | 2/2007 | Qingguo et al. | |
| 7,635,180 | B2 | 12/2009 | Hattori et al. | |
| 7,806,044 | B2 * | 10/2010 | Lin | A47G 19/2272 220/254.8 |
| 8,128,211 | B2 | 3/2012 | Chung et al. | |
| 8,678,567 | B2 * | 3/2014 | Shimizu | B41J 2/17523 347/85 |
| 8,757,781 | B2 | 6/2014 | Ishizawa et al. | |
| 9,079,413 | B2 * | 7/2015 | Kudo | B41J 2/175 |
| 9,402,782 | B2 | 8/2016 | Browne | |
| 9,707,768 | B2 * | 7/2017 | Nishimaki | B65D 41/005 |
| 2003/0202060 | A1 | 10/2003 | Bilotta et al. | |
| 2005/0018008 | A1 | 1/2005 | Ueda et al. | |
| 2005/0116997 | A1 | 6/2005 | Katoh et al. | |
| 2005/0270342 | A1 | 12/2005 | Ogura et al. | |
| 2009/0251514 | A1 | 10/2009 | Causey et al. | |
| 2012/0056938 | A1 | 3/2012 | Ishizawa et al. | |
| 2014/0247310 | A1 | 9/2014 | Ishizawa et al. | |
| 2014/0253645 | A1 | 9/2014 | Tsukahara et al. | |
| 2015/0352850 | A1 | 12/2015 | Ishizawa et al. | |

FOREIGN PATENT DOCUMENTS

| | | | |
|---|---|---|---|
| JP | S61-081960 | A | 4/1986 |
| JP | 2009-502685 | A | 1/2009 |
| JP | 2012-051306 | A | 3/2012 |
| WO | WO-2007/016421 | A2 | 2/2007 |

* cited by examiner

PLUG MEMBER AND LIQUID CONTAINER UNIT

CROSS REFERENCE TO RELATED APPLICATIONS

This application is a continuation of U.S. application Ser. No. 15/066,547 filed Mar. 10, 2016; which claims priority to Japanese Appl. No. 2015-049564 filed Mar. 12, 2015; the contents of both of which are incorporated by reference herein in their entirety.

BACKGROUND

Field

The present invention relates to a technology with regard to a plug member configured to close a liquid inlet.

Related Art

A plug member has been conventionally known to close a liquid inlet of a liquid container assembly (for example, JP 2012-51306A). The plug member disclosed in JP 2012-51306A is detachably mounted to the liquid inlet to close the liquid inlet. This plug member includes a sealing part in a cylindrical form that is inserted into the liquid inlet to close the liquid inlet and a prominent grip portion that is disposed in a center part of a top of the sealing part. This plug member is linked with an adjacent plug member by a linkage member.

There may be various problems with regard to the technology using the plug member detachably mounted to the liquid inlet. For example, the liquid adhering to the sealing part of the plug member is likely to be splashed around when the plug member is pulled out of the liquid inlet. More specifically, for example, when the user grips the grip portion and pulls the plug member out of the liquid inlet, the plug member is pulled out along a center axis of the sealing part (i.e., center axis of the liquid inlet). In this case, the plug member is pulled out of the liquid inlet abruptly, so that the liquid adhering to the sealing part is more likely to be splashed around.

In the technique disclosed in JP 2012-51306A, the two plug members are linked by the linkage member. This may make one plug member likely to be mistakenly mounted to the other liquid inlet when the two plug members linked with each other are pulled out of the corresponding liquid inlets and are then to be mounted again to the respective inlets. This may lead to a problem that the liquid contained in a liquid container assembly having the other liquid inlet is contaminated with the liquid adhering to the mistakenly mounted plug member. In the state that the two plug members are pulled out of the corresponding liquid inlets, there is a possibility that the two plug members are lost. When the plug member is pulled out of the liquid inlet, the liquid may adhere to a mounting surface where the pulled-out plug member is placed and stain the mounting surface.

The invention has the following objects to solve at least part of the problems described above. One object of the invention is to provide a technique that reduces the likelihood that various problems arise with regard to the technology using a plug member detachably mounted to a liquid inlet. Another object of the invention is to provide a technique that reduces the likelihood that a plug member is mistakenly mounted to a liquid inlet of another liquid container assembly. Another object of the invention is to provide a technique that reduces the likelihood that a plug member is lost. Another object of the invention is to provide a technique that allows a plug member to be readily pulled out of a liquid inlet. With regard to the prior art, other needs include cost reduction, resource saving, easy manufacture and improvement of usability.

SUMMARY

In order to solve at least part of the problems described above, the invention may be implemented by aspects described below.

(1) According to one aspect of the invention, there is provided a plug member detachably mounted to a liquid inlet to close the liquid inlet. The plug member comprises a sealing part configured to close the liquid inlet, such that at least part of the sealing part is inserted in the liquid inlet; and a cover part arranged around at least part of circumference of the sealing part.

In the plug member of this aspect, when the sealing part is pulled out from inside of the liquid inlet and the plug member is demounted from the liquid inlet, the cover serves as the barrier. This reduces the likelihood that the liquid adhering to the sealing part is splashed around to the outer side of the cover part.

(2) In the plug member of the above aspect, the cover part may be arranged to cover entire circumference of the sealing part.

In the plug member of this aspect, the cover part arranged to cover the entire circumference of the sealing part further reduces the likelihood that the liquid is splashed around.

(3) In the plug member of the above aspect, the cover part may comprise a grip portion that is connected with an opposite end portion of the sealing part opposite to a mounting direction of the plug member to the liquid inlet and is extended along a direction intersecting with the mounting direction.

In the plug member of this aspect, the grip portion is extended along the direction intersecting with the mounting direction. This enables the user to readily grip the grip portion and facilitates the user's operations of mounting and demounting the plug member to and from the liquid inlet. When the plug member is placed on a mounting surface such as a desk such that the grip portion-side of the plug member faces down, the configuration of the grip portion that is extended along the direction intersecting with the mounting direction suppresses the plug member from rolling on the mounting surface.

(4) In the plug member of the above aspect, the cover part may comprise a cover main body arranged around at least part of the circumference of the sealing part; and a grip portion in a columnar shape that is connected with an opposite end portion of the cover main body opposite to a mounting direction of the plug member to the liquid inlet.

The user can readily mount and demount the plug member of this aspect to and from the liquid inlet by simply gripping the grip portion of the columnar shape.

(5) In the plug member of the above aspect, the liquid inlet may be provided in a liquid container assembly that is configured to contain a liquid. The grip portion may comprise a recess that is provided in a grip portion end portion opposite to the mounting direction; and an identification portion that is placed in the recess and is configured to identify a type of the liquid contained in the liquid container assembly.

The plug member of this aspect reduces the likelihood that the plug member is mistakenly mounted to a liquid inlet of a liquid container assembly that is configured to contain a different type of liquid.

(6) In the plug member of the above aspect, degree of hardness of the sealing part may be different from degree of hardness of the cover part.

In the plug member of this aspect, the sealing part and the cover part may be configured to have different degrees of hardness.

(7) The plug member of the above aspect may further comprise a mounted part that is connected with the cover part and is attachable to a mounting structure provided in a neighborhood of the liquid inlet.

In the plug member of this aspect, attaching the mounted part to the mounting structure reduces the likelihood that the plug member is lost.

(8) According to another aspect of the invention, there is provided a liquid container unit. This liquid container unit comprises the plug member of the above aspect; a liquid container assembly configured to have the liquid inlet; a case configured to cover at least part of the liquid container assembly; and the mounting structure placed in the case.

In the liquid container unit of this aspect, attaching the mounted part to the mounting structure reduces the likelihood that the plug member is lost.

(9) The liquid container unit of the above aspect may further comprise a plug member-placing structure placed in the case and is configured such that the plug member is placed on the plug member-placing structure.

In the liquid container unit of this aspect, placing the plug member demounted from the liquid inlet on the plug member-placing structure reduces the likelihood that the periphery is stained with the liquid.

(10) According to another aspect of the invention, there is provided a liquid container unit. This liquid container unit comprises the plug member of the above aspect; a liquid container assembly configured to have the liquid inlet; a case configured to cover at least part of the liquid container assembly; and a plug member-placing structure placed in the case and is configured such that the plug member is placed on the plug member-placing structure.

In the liquid container unit of this aspect, placing the plug member demounted from the liquid inlet on the plug member-placing structure reduces the likelihood that the periphery is stained with the liquid.

(11) The liquid container unit of the above aspect may comprise two sets of the plug members, the liquid container assemblies, the mounting structures and the plug member-placing structures. One set is specified as a first plug member, a first liquid container assembly, a first mounting structure and a first plug member-placing structure, and the other set is specified as a second plug member, a second liquid container assembly, a second mounting structure and a second plug member-placing assembly. The mounted part of the first plug member may be configured to have such a length that does not allow the sealing part of the first plug member to be inserted into the liquid inlet of the second liquid container assembly and that does not allow the first plug member to be placed on the second plug member-placing structure, in a state that the mounted part of the first plug member is attached to the first mounting structure.

The liquid container unit of this aspect reduces the likelihood that the sealing part of the first plug member is mistakenly inserted into the liquid inlet of the second liquid container assembly and the likelihood that the first plug member is mistakenly placed on the second plug member-placing structure.

(12) In the liquid container unit of the above aspect, the first mounting structure and the second mounting structure may be arranged across the first plug member-placing structure and the second plug member-placing structure with regard to a predetermined direction. The first mounting structure may be disposed on the first plug member-placing structure side, and the second mounting structure may be disposed on the second plug member-placing structure side.

The liquid container unit of this aspect reduces the likelihood that one plug member is mistakenly mounted to the other liquid inlet.

(13) In the liquid container unit of the above aspect, the plug member-placing structure may have a sealing part-mounting portion that is configured such that the sealing part of the plug member is mountable to the sealing part-mounting portion. When the sealing part is mounted to the sealing part-mounting portion, a bottom face of the plug member-placing structure and the cover part may be arranged to be away from each other by an interval.

In the liquid container unit of the above aspect, the bottom face and the cover part are arranged to be away from each other by the interval. This reduces the likelihood that the liquid present on the bottom face adheres to the cover part.

(14) In the liquid container unit of the above aspect, the sealing part may have a recess that is open on a mounting direction side of the plug member to the liquid inlet. The sealing part-mounting portion may be a projection that is protruded from the bottom face and is inserted into the recess.

In the liquid container unit of this aspect, insertion of the projection into the recess enables the plug member to be stably placed on the sealing part-mounting portion.

(15) In the liquid container unit of the above aspect, the plug member-placing structure may comprise a first surface which the cover part is placed on, and a receiving portion that is in a concave shape to receive the sealing part and has a bottom face that is located at a lower position than the first surface.

The liquid container unit of this aspect prevents the cover part from coming into contact with the bottom face of the receiving portion. This accordingly reduces the likelihood that the liquid adheres to the cover part.

(16) According to another aspect of the invention, there is provided a liquid container unit comprising a liquid container assembly configured to contain a liquid that is to be supplied to a liquid ejecting portion, and an exterior member configured to cover the liquid container assembly. This liquid container unit comprises a liquid inlet provided in the liquid container assembly and configured to inject the liquid into the liquid container assembly; a plug member configured to close the liquid inlet; a visible portion that is configured to make a liquid level in the liquid container assembly visible from outside; and a plug member-placing structure that is placed on the exterior member and is configured such that the plug member is placed on the plug member-placing structure. The plug member-placing structure is located on an opposite side to the visible portion across the liquid inlet.

The liquid container unit of this aspect reduces the likelihood that the plug member moves toward the visible portion in the course of demounting the plug member from the liquid inlet and placing the plug member on the plug member-placing structure. This accordingly reduces the likelihood that the visible portion is stained with the liquid.

(17) According to another aspect of the invention, there is provided a liquid container unit comprising a liquid container assembly configured to contain a liquid that is to be supplied to a liquid ejecting portion, and an exterior member configured to cover the liquid container assembly. This liquid container unit comprises a liquid inlet provided in the liquid container assembly and is configured to inject the liquid into the liquid container assembly; a plug member configured to close the liquid inlet; a visible portion configured to make a liquid level in the liquid container assembly visible from outside; and a mounting structure provided on the exterior member and is configured such that the plug member is attached to the mounting structure. The mounting structure is located on an opposite side to the visible portion across the liquid inlet. The plug member comprises a mounted part that is to be attached to the mounting structure. The mounted part is configured to have a length that is shorter than a distance from the mounting structure to the visible portion in a state that the mounted part is attached to the mounting structure.

The liquid container unit of this aspect reduces the likelihood that the visible portion is stained with the liquid when the plug member is demounted from the liquid inlet in the state that the mounted part is attached to the mounting structure.

(18) In the liquid container unit of the above aspect, the exterior member may comprise a recess having a first bottom face in which an insertion hole is formed and a second bottom face which is located at a higher position than the first bottom face and on which the plug member-placing structure is formed. The liquid inlet may be arranged to be inserted through the insertion hole and to locate an opening at one end on the recess side.

In the liquid container unit of this aspect, the recess can keep the liquid even when the liquid adheres to the second bottom face on which the plug member-placing structure is formed and flows from the second bottom face toward the first bottom face.

All the plurality of components included in each of the aspects of the invention described above are not essential, but some components among the plurality of components may be appropriately changed, omitted or replaced with other components or part of the limitations may be deleted, in order to solve part or all of the problems described above or in order to achieve part or all of the advantageous effects described herein. In order to solve part or all of the problems described above or in order to achieve part or all of the advantageous effects described herein, part or all of the technical features included in one aspect of the invention described above may be combined with part or all of the technical features included in another aspect of the invention described above to provide still another independent aspect of the invention.

For example, one aspect of the invention may be implemented as an apparatus comprising one or more components among the plurality of components, i.e., the sealing part and the cover part. More specifically, this apparatus may have or may not have the sealing part. This apparatus may have or may not have the cover part.

In another example, another aspect of the invention may be implemented as an apparatus comprising one or more components among the plurality of components, i.e., the plug member, the liquid container assembly, the case and the mounting structure. More specifically, this apparatus may have or may not have the plug member. This apparatus may have or may not have the liquid container assembly. This apparatus may have or may not have the case. This apparatus may have or may not have the mounting structure.

Any of these aspects described above solves at least one of various problems such as downsizing of the apparatus, cost reduction, resource saving, easy manufacture and improvement of usability. The technical features in each of the various aspects of the plug member and the liquid container unit may be applicable to these apparatuses.

The invention may be implemented by various aspects other than the plug member and the liquid container unit described above, for example, a method of manufacturing the plug member or a liquid ejection system including the liquid container unit.

DESCRIPTION OF THE EMBODIMENTS

A. First Embodiment

Figure 1:
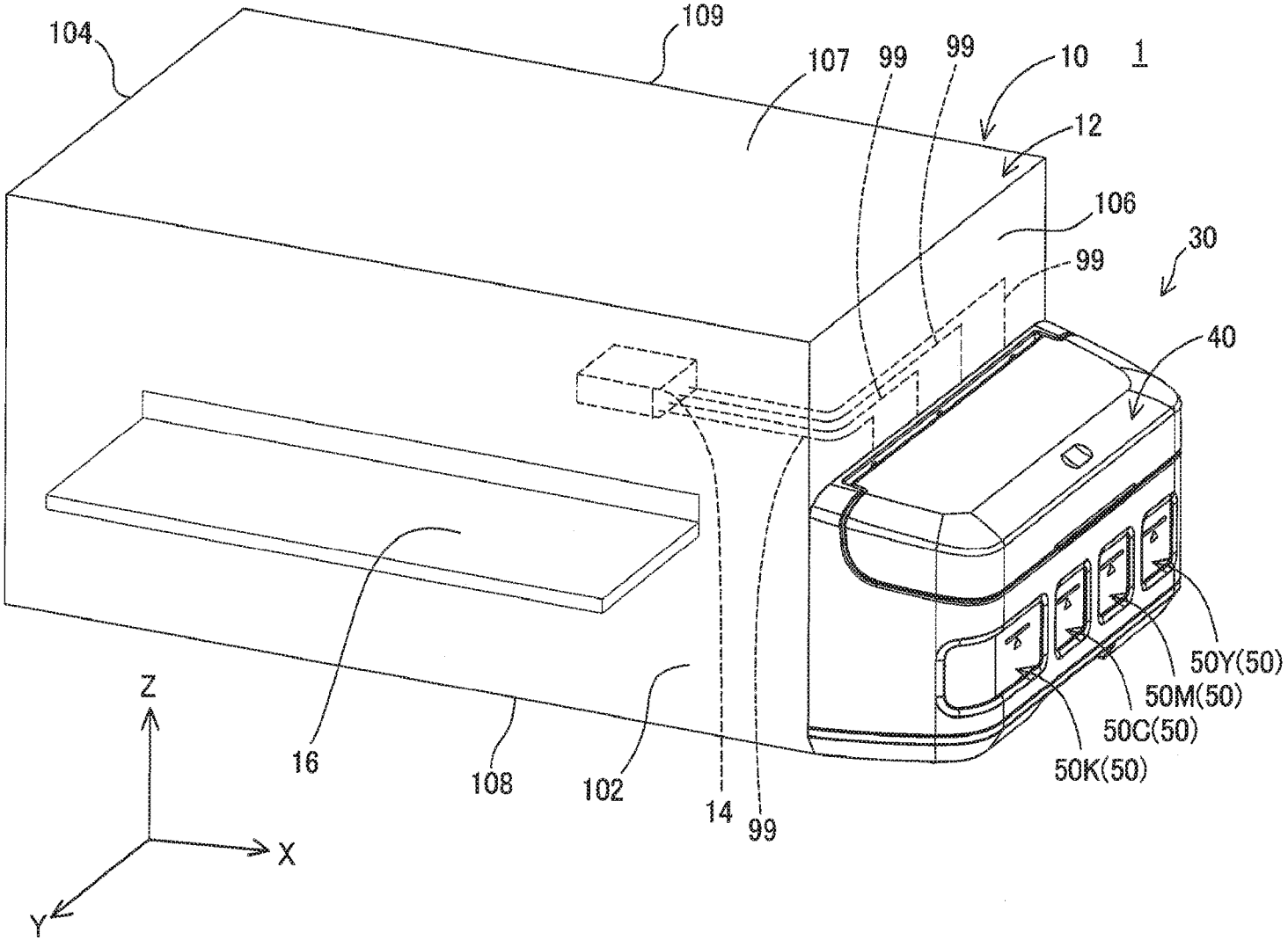
FIG. 1 is an appearance diagram illustrating a liquid ejection system according to a first embodiment of the invention.

FIG. 1 is an appearance diagram illustrating a liquid ejection system 1 according to a first embodiment of the invention. XYZ axes orthogonal to one another are illustrated in FIG. 1. XYZ axes corresponding to those of FIG. 1 are also illustrated in other drawings as appropriate.

The liquid ejection system 1 includes a printer 10 as a liquid ejection apparatus and a liquid container unit 30. In the use state of the liquid ejection system 1, the printer 10 and the liquid container unit 30 are placed on a horizontal plane defined by an X-axis direction and a Y-axis direction. In other words, a Z-axis direction is a vertical direction (top-bottom direction). −Z-axis direction denotes vertically downward direction and +Z-axis direction denotes vertically upward direction.

The printer 10 is an inkjet printer. The printer 10 includes a record head 14 that serves as a liquid ejecting portion to eject ink in the form of a liquid onto a recording medium such as sheet and a housing 12 that is configured to place the record head 14 therein. The housing 12 is in an approximately rectangular parallelepiped shape. The housing 12 includes a front surface (first surface, first wall) 102, a left side surface (first side surface, first side wall) 104, a right side surface (second side surface, second side wall) 106, a top surface (third surface, third wall) 107, a bottom surface (fourth surface, fourth wall) 108 and a rear surface (second surface, second wall) 109. The respective surfaces 102, 104, 106, 107, 108 and 109 constitute the housing 12 as the outer shell of the printer 10. An eject tray 16 to which the recording medium such as sheet is discharged is provided on the front surface 102.

The front surface 102 and the rear surface 109 are opposed to each other. The left side surface 104 and the right side surface 106 are opposed to each other. The front surface 102, the rear surface 109, the left side surface 104 and the right side surface 106 are surfaces approximately perpendicular to an installation surface on which the printer 10 is installed. The top surface 107 and the bottom surface 108 are opposed to each other. The top surface 107 and the bottom surface 108 are surfaces approximately horizontal to the installation surface on which the printer 10 is installed. The left side surface 104 and the right side surface 106 intersect with both the front surface 102 and the rear surface 109. The terminology "approximately perpendicular" and "approximately horizontal" herein includes almost "perpendicular" and almost "horizontal", in addition to completely "perpendicular" and completely "horizontal". More specifically, the respective surfaces 102, 104, 106, 107, 108 and 109 are not completely planar but are surfaces with concavity and convexity, so that almost "perpendicular" and almost "horizontal" are acceptable in appearance.

The direction in which the left side surface 104 and the right side surface 106 are opposed to each other is X-axis direction. The direction in which the front surface 102 and the rear surface 109 are opposed to each other is Y-axis direction. The direction in which the top surface 107 and the bottom surface 108 are opposed to each other is Z-axis direction. The X-axis direction is "width direction" of the printer 10, the Y-axis direction is "depth direction" of the printer 10, and the Z-axis direction is "height direction" of the printer 10.

The record head 14 is configured to be movable in a main scanning direction (X-axis direction). The record head 14 ejects ink while the recording medium being conveyed along the Y-axis direction inside of the housing 12, so as to perform printing (recording) on the recording medium. The record head 14 is configured to be movable in the main scanning direction according to this embodiment, but this configuration is not restrictive. For example, the record head 14 may be a line head that is extended along the X-axis direction and is fixed at position.

The liquid container unit 30 is mounted to the right side surface 106 of the housing 12. The liquid container unit (tank unit) 30 includes a case (exterior member) 40 and a plurality of liquid container assemblies 50K to 50Y placed inside of the case 40. Each of the plurality of liquid container assemblies 50K to 50Y is placed inside of the case 40 to be partly visible from outside. The plurality of liquid container assemblies 50K to 50Y are arrayed along the Y-axis direction. The liquid container assembly 50K contains black ink. The liquid container assembly 50C contains cyan ink. The liquid container assembly 50M contains magenta ink. The liquid container assembly 50Y contains yellow ink. Each of the plurality of liquid container assemblies 50K to 50Y communicates with the record head 14 by means of a corresponding flow tube 99. The ink contained in each of the plurality of liquid container assemblies 50K to 50Y is flowed through the flow tube 99 and is supplied to the record head 14 by a supply mechanism (not shown) such as pump included in the printer 10. In other words, each of the liquid container assemblies 50K to 50Y is configured to contain the ink that is to be supplied to the record head 14 as the liquid ejecting portion. When there is no need for discrimination among the plurality of liquid container assemblies 50K to 50Y, these liquid container assemblies are expressed by a symbol "50". The embodiment uses the four liquid container assemblies 50, but this number is not restrictive. The number of liquid container assemblies 50 may be three or less or may be five or more. The liquid container unit 30 is mounted to the right side surface 106 of the housing 12 according to the embodiment. According to another embodiment, the liquid container unit 30 may be mounted to another surface of the housing 12 (for example, left side surface 104) or may be provided inside of the housing 12. According to another embodiment, at least part of the case 40 of the liquid container unit 30 may be formed integrally with the housing 12 of the printer 10.

According to this embodiment, the X-axis direction is "depth direction" of the liquid container unit 30, the Y-axis direction is "width direction" of the liquid container unit 30, and the Z-axis direction is "height direction" of the liquid container unit 30.

Figure 2:
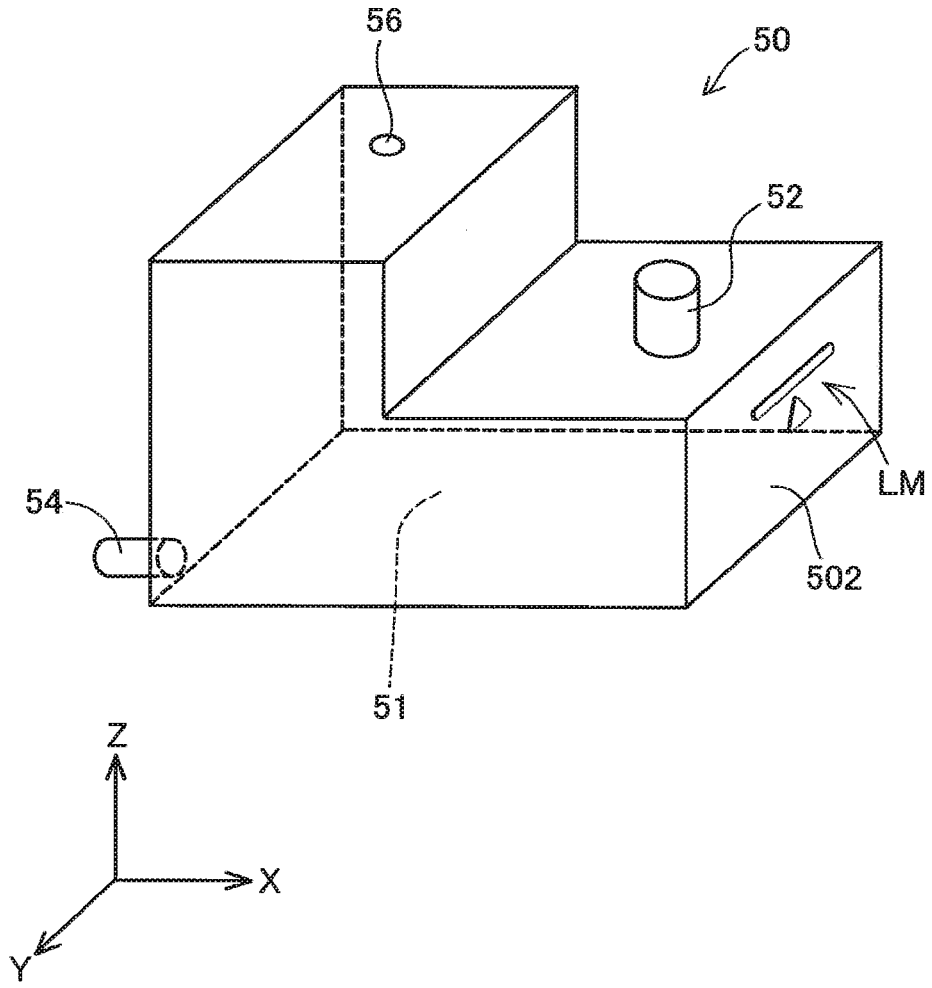
FIG. 2 is a schematic diagram illustrating a liquid container assembly.

FIG. 2 is a schematic diagram illustrating the liquid container assembly 50. The liquid container assembly 50 includes a liquid chamber (liquid container) 51 configured to contain ink, a liquid inlet (liquid injection port, liquid fill port) 52 configured to inject ink into the liquid chamber 51, an air introduction port configured to introduce the outside air into the liquid chamber 51, and a liquid discharge portion 54 configured to discharge ink. The liquid inlet 52 is in a tubular form. In the use state that ink is supplied from the liquid container assembly 50 to the record head 14 and in the injection state that ink is injected from the liquid inlet 52 into the liquid chamber 51, the liquid inlet 52 is open upward in the vertical direction. In the use state, the liquid inlet 52 is closed by a plug member describes later. The liquid discharge portion 54 is connected with the flow tube (tube) 99 to make the liquid container assembly 50 communicate with the printer 10. The ink contained in the liquid chamber 51 is flowed through the liquid discharge portion 54 and the flow tube 99 toward the record head 14. With consumption of the ink in the liquid chamber 51, the liquid level goes down in the liquid chamber 51 and the air is introduced from the air introduction port 56 into the liquid chamber 51. When the remaining amount of ink is reduced in the liquid chamber 51, the user detaches the plug member from the liquid inlet 52 and injects ink from the liquid inlet 52 into the liquid chamber 51.

The liquid container assembly 50 has an identification surface 502 that is arranged vertically relative to the installation surface in the use state of the liquid container unit 30. The identification surface 502 forms part of the liquid chamber 51. The identification surface 502 is a transparent or translucent member to make the ink level in the liquid chamber 51 identifiable from outside. The identification surface 502 has an upper limit indicator LM to indicate an upper limit of ink containable in the liquid chamber 51. The upper limit indicator LM has a horizontal linear portion. The user stops injection of ink into the liquid chamber 51 when the ink level reaches the linear portion as the indication.

Figure 3:
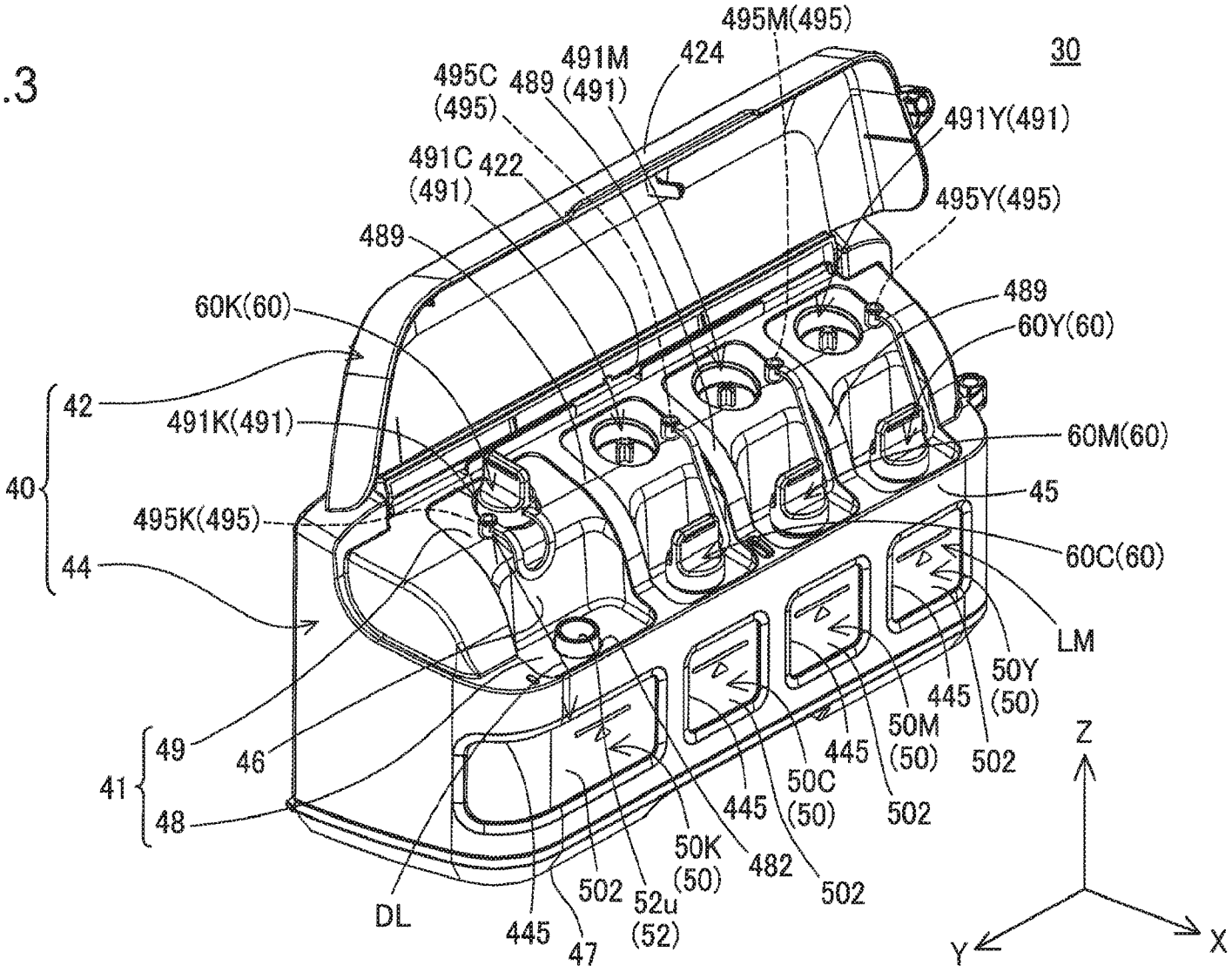
FIG. 3 is a perspective view illustrating a liquid container unit.
Figure 4:
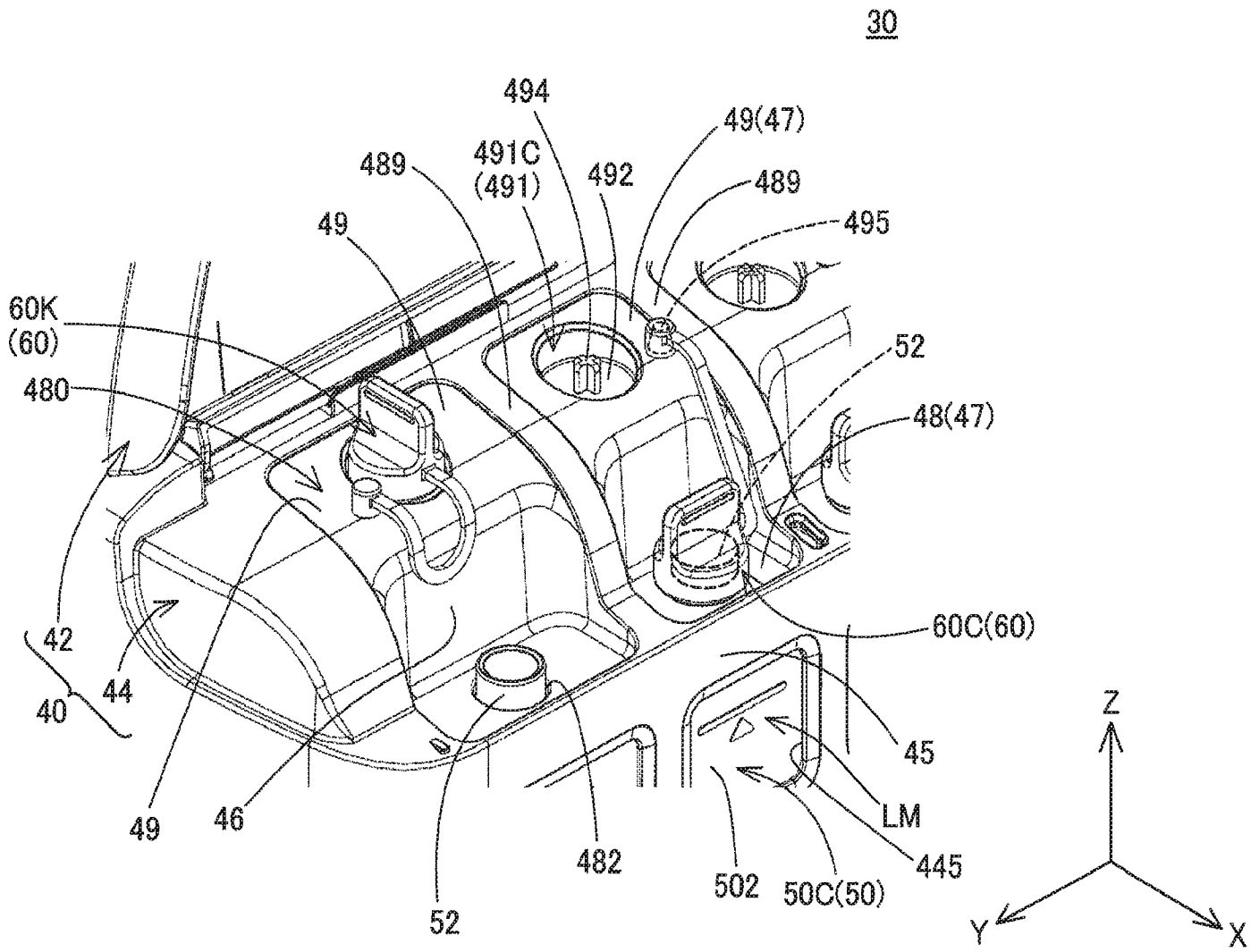
FIG. 4 is an enlarged view illustrating part of the liquid container unit shown in FIG. 3.

FIG. 3 is a perspective view illustrating the liquid container unit 30. FIG. 4 is a partial enlarged view illustrating the liquid container unit 30 shown in FIG. 3. The case 40 shown in FIG. 3 is in the state that a cover member is open. In the state of FIG. 3, the liquid inlets 52 of the liquid container assemblies 50C, 50M and 50Y are respectively closed by corresponding plug members 60C, 60M and 60Y, while a plug member 60K is detached from the liquid inlet 52 of the liquid container assembly 50K.

The plug member 60C (shown in FIG. 3) is a member provided to close the liquid inlet 52 of the liquid container assembly 50C. The plug member 60M is a member provided to close the liquid inlet 52 of the liquid container assembly 50M. The plug member 60Y is a member provided to close the liquid inlet 52 of the liquid container assembly 50Y. The plug member 60K is a member provided to close the liquid inlet 52 of the liquid container assembly 50K. When there is no need for discrimination among the respective plug members 60C to 60K, these plug members are expressed by a symbol "60". The plug member 60 is detachably mounted to the liquid inlet 52 to close the liquid inlet 52. The detailed configuration of the plug member 60 will be described later.

The case (exterior member) 40 is configured to cover the liquid container assemblies 50. The case 40 includes a cover member 42 and a case main body 44. The case main body 44 is configured to place the liquid container assemblies 50 inside thereof and protect the liquid container assemblies 50 from an external force such as impact. The cover member 42 is configured to be openable and closable by rotating the other end 424 about one end 422 on the printer 10-side (−X-axis direction side) as the supporting point. In order to inject ink into the liquid container assembly 50, the user opens the cover member 42 and detaches the plug member 60 from the liquid inlet 52.

The case main body 44 has a case upper surface (case upper wall) 41, a case bottom surface (case bottom wall) 47 and a case circumferential surface (case circumferential wall) 45. The case upper surface 41 and the case bottom surface 47 are opposed to each other. The case circumferential surface 45 is provided as a surface to connect the case upper surface 41 with the case bottom surface 47. The case circumferential surface 45 has visible portions 445 configured to allow the liquid container assemblies 50 (more specifically, their identification surfaces 502) to be visible from outside. According to this embodiment, the visible portions 445 are openings that are open in the horizontal direction. According to another embodiment, the visible portion 445 may be provided as a transparent member or a translucent member, instead of the opening. According to this embodiment, the visible portion 445 and the identification surface 502 are arranged adjacent to each other. According to another embodiment, the visible portion 445 and the identification surface 502 may be arranged to be in contact with each other.

As described above, the visible portion 445 and the identification surface 502 are provided as elements that allows the user to visually recognize the liquid level of ink in the liquid chamber 51 from outside. Accordingly at least either one of the visible portion 445 and the identification surface 502 corresponds to the "visible portion" described in Summary.

The case upper surface 41 includes a first upper surface 48 and a second upper surface 49 that is located vertically above the first upper surface 48. A step 46 is formed between the first upper surface 48 and the second upper surface 49. The first upper surface 48 is an approximately horizontal surface. An insertion hole 482 which the liquid inlet 52 is inserted through is formed in the first upper surface 48. An upper end portion including an upper end opening 52*u* of the liquid inlet 52 is protruded from the first upper surface 48.

The case 40 also has a plurality of plug member-placing structures 491K to 491Y and a plurality of mounting structures 495K to 495Y. The plurality of plug member-placing structures 491K to 491Y and the plurality of mounting structures 495K to 495Y are placed on the second upper surface 49. The plurality of plug member-placing structures 491K to 491Y are arrayed along the Y-axis direction. The plurality of mounting structures 495K to 495Y are arrayed along the Y-axis direction.

The plurality of plug member-placing structures 491K to 491Y are configured to place the corresponding plug members 60K to 60Y (more specifically their plug bodies described later). More specifically, the plug member-placing structure 491K is a portion configured to place the plug member 60K detached from the liquid inlet 52. The plug member-placing structure 491C is a portion configured to place the plug member 60C detached from the liquid inlet 52. The plug member-placing structure 491M is a portion configured to place the plug member 60M detached from the liquid inlet 52. The plug member-placing structure 491Y is a portion configured to place the plug member 60Y detached from the liquid inlet 52. When there is no need for discrimination among the plug member-placing structures 491K to 491Y, these plug member-placing structures are expressed by a symbol "491".

The plug member-placing structure 491 (shown in FIG. 4) is a recess formed in the second upper surface 49. Part of the plug member 60 is received in the recess. The plug member-placing structure 491 is configured to keep ink in this recess. The plug member-placing structure 491 includes a bottom face 492 and a protrusion 494 as a sealing part-mounting structure. The protrusion 494 is protruded vertically upward from the bottom face 492. The protrusion 494 is a portion configured to receive insertion of part of the plug member 60 (described later in detail), so that the plug member 60 is mounted (held) on the protrusion 494. The plug member-placing structure 491 is preferably configured to keep ink. For example, the plug member-placing structure 491 may be a recess as described in this embodiment or may be a porous member placed on the second upper surface 49.

The plug member-placing structure 491 is located on the opposite side to the visible portion 445 across the liquid inlet 52. In other words, the liquid inlet 52 is located in the middle of the route from the plug member-placing structure 491 to the visible portion 445 on the exterior member 40.

The plurality of mounting structures 495K to 495Y (shown in FIG. 3) are portions which the corresponding plug members 60K to 60Y (more specifically, mounted parts of the plug members 60 described later) are mountable to. The plurality of mounting structures 495K to 495Y are respectively provided as columnar projections protruded from the second upper surface 49. The plug member 60K is mounted to the mounting structure 495K. The plug member 60C is mounted to the mounting structure 495C. The plug member 60M is mounted to the mounting structure 495M. The plug member 60Y is mounted to the mounting structure 495Y. The mounting structure 495 is provided in the vicinity of the liquid inlet 52. According to this embodiment, the mounting structure 495 is located on the member where the liquid inlet 52 is placed (case main body 44 in the embodiment) to be provided in the vicinity of the liquid inlet 52.

The case main body 44 has partition walls 489 protruded from the second upper surface 49. The partition walls 489 are located between the adjacent plug member-placing structures 491, between the adjacent insertion holes 482, and between the adjacent mounting structures 495. Providing the partition walls 489 reduces the likelihood that the user mistakenly places the plug member 60 (for example, plug member 60K) on a wrong plug member-placing structure 491 (for example, plug member-placing structure 491C).

The liquid container unit 30 is further described with reference to FIGS. 3 and 4. The exterior member 40 has recesses 480 located vertically on the upper side in the injection state and in the use state. A bottom face of the recess 480 is defined by the second upper surface 49, the step (step face) 46 and the first upper surface 48. The first upper surface 48 is also called "first bottom face 48", and the second upper surface 49 is also called "second bottom face 49". The insertion hole 482 is formed in the first bottom face 48. The liquid inlet 52 is arranged to be inserted through the insertion hole 482 and locate its upper end opening 52*u* at one end on the recess 480-side (shown in FIG. 4). More specifically, the upper end opening 52*u* is located vertically above the first upper surface 48. It is preferable that the inner circumferential surface of the insertion hole 482 is air-tightly in contact with the outer circumferential surface of the liquid inlet 52 inserted through the insertion hole 482. This configuration reduces the likelihood that ink splashed around the liquid inlet 52 (for example, on the first bottom face 48) moves through the insertion hole 482 and enters the case main body 44. This advantageous effect may also be provided by placing, for example, a ring-shaped seal member between the inner circumferential surface of the insertion hole 482 and the outer circumferential surface of the liquid inlet 52. On the contrary, a clearance may be provided between the insertion hole 482 and the outer circumferential surface of the liquid inlet 52, so that ink may be introduced through the clearance into the case main body 44 using the inner surface of the insertion hole 482 as an ink guide surface. In the latter application, in order to prevent the ink introduced into the case main body 44 from flowing toward the visible portion 445 (or the identification surface 502), an ink absorbing material may be placed along the liquid container assembly 40 inside of the case main body 44 or the liquid container assembly 50 may be configured to introduce the ink in a different direction from the direction of the visible portion 445. These configurations suppress ink from being left outside of the case main boy 44.

The second bottom face 49 is located at a higher position than (at a position vertically above) the first bottom face 48. The plug member-placing structure 491 is formed in the second bottom face 49. The first bottom face 48 and the second bottom face 49 are connected by means of the step 46. One of the walls defining and forming the recess 480 is the partition wall 489. Even when ink adheres to the second bottom face 49 on which the plug member-placing structure 492 is formed and flows from the second bottom face 49 to the first bottom face 48, this configuration enables ink to be kept in the recess 480. This accordingly reduces the likelihood that the periphery of the recess 480 (for example, the visible portion 445 and the identification surface 502) is stained with ink.

Figure 5:
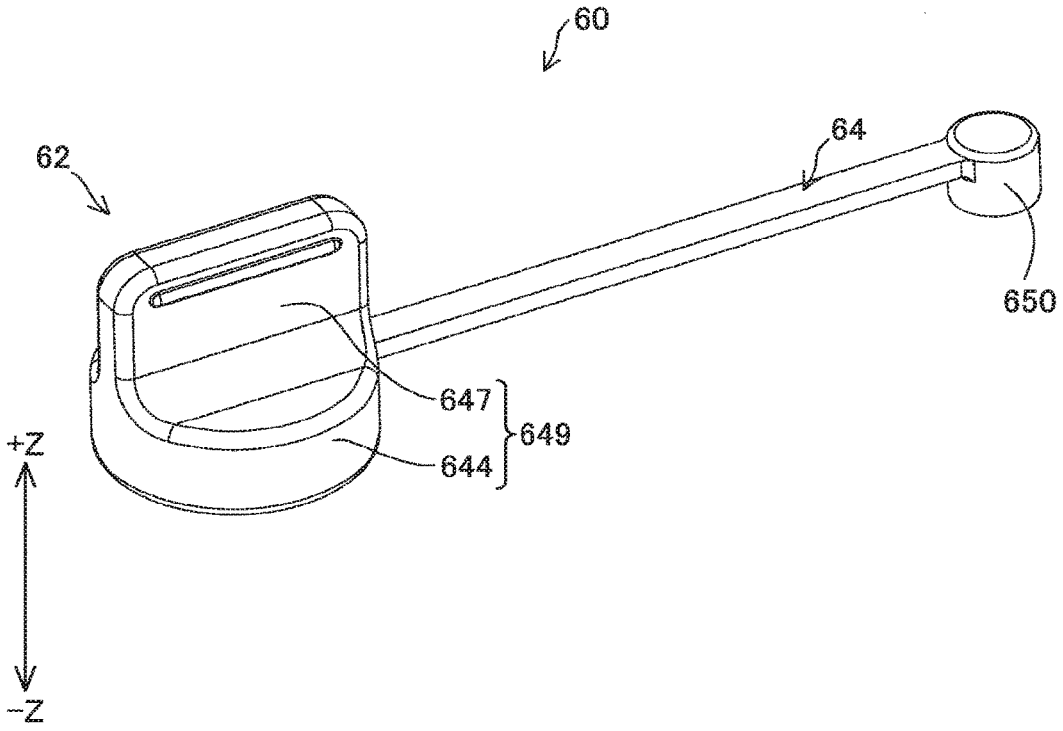
FIG. 5 is a perspective view illustrating a plug member.
Figure 6:
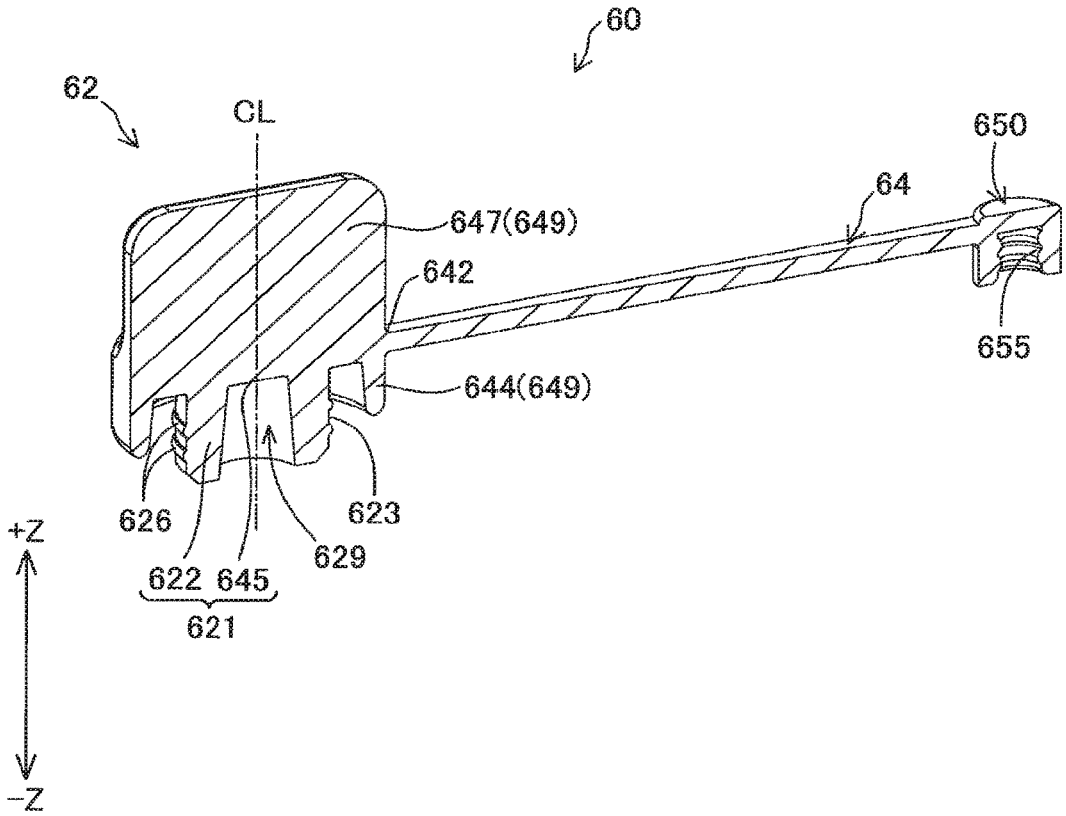
FIG. 6 is a sectional view illustrating the plug member.

FIG. 5 is a perspective view illustrating the plug member 60. FIG. 6 is a sectional view illustrating the plug member 60. FIG. 5 shows the Z axis in the use state of the liquid ejection system 1. The plug member 60 (shown in FIG. 5) includes a plug main body 62 and a mounted part 64. The plug member 60 is integrally molded from a resin material. The plug member 60 has flexibility. The plug member 60 may not be necessarily produced by integral molding but may be produced by a different method. For example, the plug main boy 62 and the mounted part 64 may be molded from different materials and subsequently assembled.

The plug main body 62 is detachably mounted to the liquid inlet 52. The mounting direction of the plug main body 62 to the liquid inlet 52 is −Z-axis direction. The plug main body 62 (shown in FIG. 6) includes a sealing part 621 and a cover part 649.

The sealing part 621 includes a first seal portion 622 in a tubular form and a second seal portion 645 connecting with one end of the first seal portion 622. The first seal portion 622 of the tubular form is inserted into the liquid inlet 52. The inner circumferential surface of the liquid inlet 52 is then air-tightly in contact with an outer circumferential surface 623 of the first seal portion 622. The outer circumferential surface 623 of the first seal portion 622 is provided with two circular projections 626 to enhance the air tightness. The second seal portion 645 is configured to close the opening at one end of the first seal portion 622. In other words, the sealing part 621 is a tubular member having a bottom at one end on the vertically upper side. The sealing part 621 has a recess 629 that is open on the mounting direction (−Z-axis direction) side.

The cover part 649 includes a cover main body 644 and a grip portion 647. The cover main body 644 is arranged to cover the periphery including an axial line CL of the first seal portion 622 as the center. According to this embodiment, the cover main body 644 is arranged to cover over the periphery including the axial line CL of the first seal portion 622 as the center. The cover main body 644 is in a circular form. The cover main body 644 is arranged to be away from the first seal portion 622 in the radial direction via a clearance. The cover main body 644 is formed to be concentric with the first seal portion 622 in a section perpendicular to the axial line CL. The cover main body 644 is, however, not limited to the above configuration. According to another embodiment, the cover main body 644 may have a section perpendicular to the axial line CL (mounting direction of the plug member 60) formed in a frame-like shape to surround the circumference of the first seal portion 622. The section of the cover main body 644 perpendicular to the axial line CL may be formed in a rectangular frame-like shape, a circular frame-like shape or a polygonal frame-like shape.

The grip portion 647 is a portion which the user grips in the course of mounting and demounting the plug member 60 to and from the liquid inlet 52. The grip portion 647 is connected with the second seal portion 645 of the sealing part 621 at an opposite end (one end) opposite to the mounting direction (−Z-axis direction). The grip portion 647 (shown in FIG. 6) is in a plate-like form. The grip portion 647 is extended along a direction (horizontal direction) intersecting with the mounting direction. More specifically, as shown in FIG. 6, the grip portion 647 is placed on the second seal portion 645 to intersect with the axial line CL.

The mounted part 64 has one end portion 642 connecting with the cover part 649. The other end portion 650 is detachably attached to the mounting structure 495 (shown in FIG. 4). The other end portion 650 is in a bottomed tubular form. The other end portion 650 has a recess 655 that is open in the mounting direction (−Z-axis direction). The prominent mounting structure 495 (shown in FIG. 4) is inserted into the recess 655, so that the mounted part 64 is attached to the mounting structure 495 irrespective of mounting or demounting of the plug member 60 to or from the liquid inlet 52. Attachment of the mounted part 64 of the plug member 60 to the mounting structure 495 reduces the possibility that the plug member 60 is lost.

Figure 7:
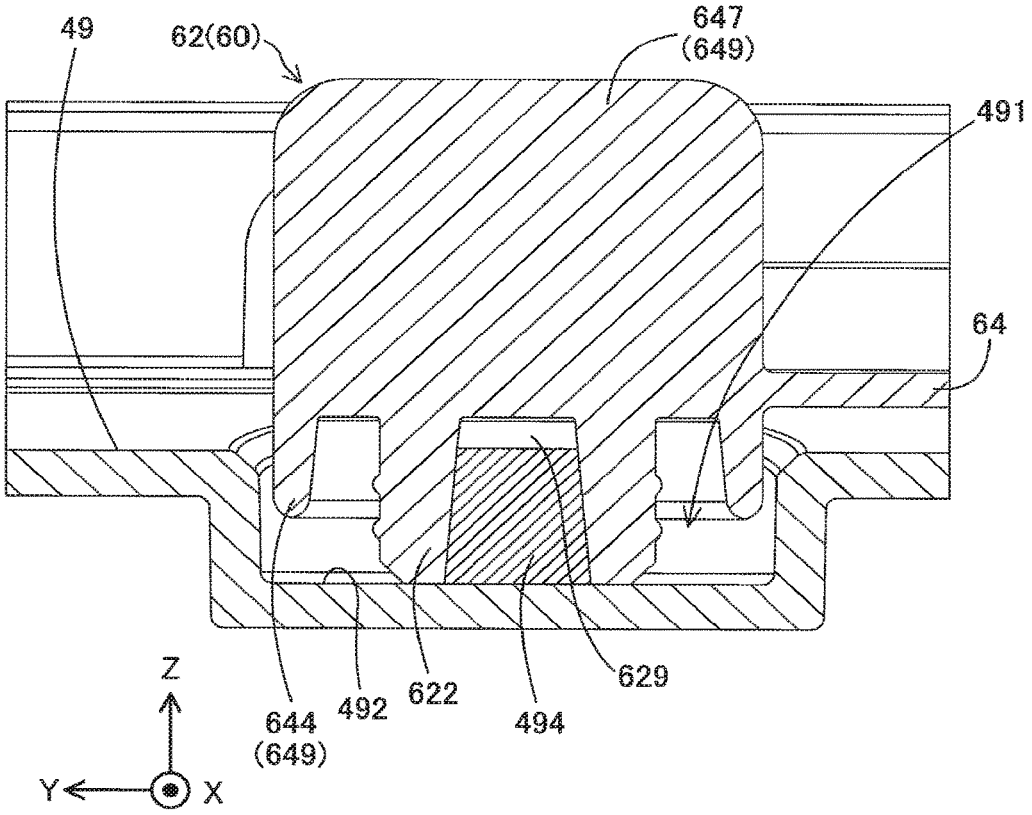
FIG. 7 is a sectional view illustrating a state that the plug member is placed on a plug member-placing structure.

FIG. 7 is a sectional view illustrating the plug member 60 placed on the plug member-placing structure 491. Mounting the first seal portion 622 of the plug member 60 to the protrusion 494 as the sealing part-mounting structure places the plug member 60 on the plug member-placing structure 491. In the state that the first seal portion 622 is mounted to the protrusion 494, the cover part 649 is disposed to be not in contact with but to be away from the bottom face 492 as the lowermost face of the plug member-placing structure 491 by an interval. According to this embodiment, the cover main body 644 is located vertically above a vertically lower end of the first seal portion 622. This configuration reduces the likelihood that ink on the bottom face 492 adheres to the cover part 649 even when ink is present on the bottom face 492.

Figure 8:
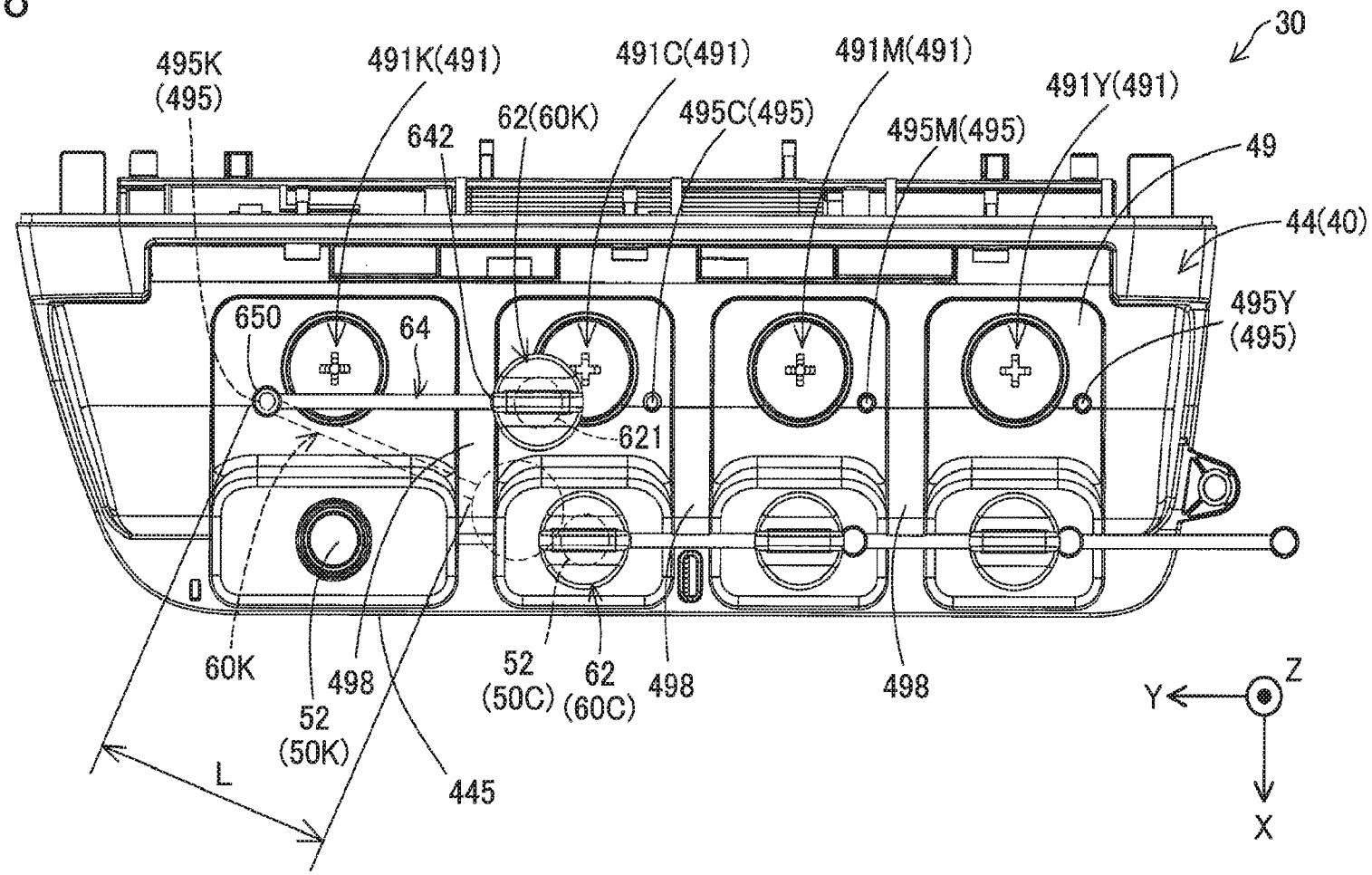
FIG. 8 is a diagram illustrating relationship between the plug member and other components.

FIG. 8 is a diagram illustrating the relationship between the plug member 60 and other components. FIG. 8 is a top view of the liquid container unit 30. With regard to the Y-axis direction as the predetermined direction, the two mounting structures 495K and 495C are arranged across the plug member-placing structures 491K and 491C. The mounting structure 495K is placed on the plug member-placing structure 491K-side. The mounting structure 495C is placed on the plug member-placing structure 491C-side. This configuration reduces the likelihood that one plug member 60K (60C) is mistakenly mounted to the liquid inlet 52 of the other liquid container assembly 50C (50K).

The mounted part 64 of the plug member 60K has a length L that does not allow the sealing part 621 of the plug member 60K to be inserted into the liquid inlet 52 of the adjacent liquid container assembly 50C in the state that the other end portion 650 of the plug member 60K is attached to the mounting structure 495K. The mounted part 64 of the plug member 60K has also the length L that does not allow the plug member 60K to be placed on the adjacent plug member-placing structure 491C in the state that the other end portion 650 of the plug member 60K is attached to the mounting structure 495K. In other words, the length L of the mounted part 64 of the plug member 60K is shorter than the shortest distance from the other end portion 650 of the plug member 60K to the plug member-placing structure 491C and the shortest distance from the other end portion 650 of the plug member 60K to the liquid inlet 52 of the liquid container assembly 50C. This configuration reduces the likelihood that the sealing part 621 of the plug member 60K is mistakenly inserted into the liquid inlet 52 of the liquid container assembly 50C. This configuration also reduces the likelihood that the plug member 60K is mistakenly placed on the plug member-placing structure 491C. This accordingly reduces the likelihood that the liquid container assembly 50C or 50K is contaminated with a different color ink via the plug member 60K. This accordingly suppresses deterioration of the printing quality of the printer 10.

The mounting structure 495 is located on the opposite side to the visible portion 445 across the liquid inlet 52. According to this embodiment, with regard to the X-axis direction, the mounting structure 495 is located on the opposite side to the visible portion 445 across the liquid inlet 52. In other words, the liquid inlet 52 is located in the middle of the course from the mounting structure 495 to the visible portion 445 on the exterior member 40. The mounted part 64 has the length L that is shorter than a shortest distance DL from the mounting structure 495 to the visible portion 445 on the exterior member 40 (shown in FIG. 3) in the state that the mounting part 64 is attached to the mounting structure 495. In other words, the mounted part 64 is set to have the length L that does not allow the plug member 60 (plug main body 62) to reach the visible portion 445 in the state that the other end portion 650 of the mounted part 64 is attached to the mounting structure 495.

The above relationship similarly applies to the relationship between the plug member 60C and the liquid inlet 52 of the liquid container assembly 50K and the relationship between the plug member 60C and the plug member-placing structure 491K. More specifically, the mounted part 64 of the plug member 60C has a length that does not allow the sealing part 621 of the plug member 60C to be inserted into the liquid inlet 52 of the adjacent liquid container assembly 50K in the state that the other end portion 650 of the plug member 60C is attached to the mounting structure 495C. The mounted part 64 of the plug member 60C also has the length that does not allow the plug member 60C to be placed on the adjacent plug member-placing structure 491K in the state that the other end portion 650 of the plug member 60C is attached to the mounting structure 495C. This configuration reduces the likelihood that the liquid container assembly 50C or 50K is contaminated with a different color ink via the plug member 60C. This accordingly suppresses deterioration of the printing quality of the printer 10. One of the plug member 60K and the plug member 60C corresponds to the "first plug member" described in Summary, and the other corresponds to the "second plug member". One of the mounting structure 495K and the mounting structure 495C corresponds to the "first mounting structure" described in Summary, and the other corresponds to the "second mounting structure". One of the plug member-placing structure 491K and the plug member-placing structure 491C corresponds to the "first plug member-placing structure" described in Summary, and the other corresponds to the "second plug member-placing structure". One of the liquid container assembly 50K and the liquid container assembly 50C corresponds to the "first liquid container assembly" described in Summary, and the other corresponds to the "second liquid container assembly".

According to the above embodiment, the plug member 60 (shown in FIGS. 5 and 6) has the cover main body 644 arranged to cover the entire circumference of the first seal portion 622. When the first seal portion 622 is pulled out from inside of the liquid inlet 52 and the plug member 60 is demounted from the liquid inlet 52, the cover main body 644 serves as the barrier. This reduces the likelihood that the ink adhering to the first seal portion 622 is splashed around to the outer side of the cover part 649. When the plug member 60 is placed on a mounting surface such as a desk, the cover main body 644 comes into contact with the mounting surface. This reduces the contact area of the first seal portion 622 that is in contact with the mounting surface.

According to the above embodiment, the plug member 60 (shown in FIGS. 5 and 6) has the grip portion 647 that is extended in the direction intersecting with the mounting direction (−Z-axis direction). This configuration enables the user to readily grip the grip portion 647 and thereby readily mount and demount the plug member 60 to and from the liquid inlet 52. The grip portion 647 is extended along the direction intersecting with the mounting direction (−Z-axis direction). When the plug member 60 is placed on a mounting surface such as a desk such that the grip portion 647-side of the plug member 60 faces down, this configuration suppresses the plug member 60 from rolling on the mounting surface. This configuration also allows the user to gradually pull the plug member 60 vertically upward out of the liquid inlet 52 about one end portion of the grip portion 647 in the extending direction as the supporting point, while gripping the other end portion of the grip portion 647. This configuration accordingly reduces the likelihood that ink adhering to the sealing part 621 is splashed around in the process of demounting the plug member 60 from the liquid inlet 52.

According to the above embodiment, the liquid container unit 30 has the plug member-placing structure 491 formed on the second upper surface 49 (shown in FIG. 4). The plug member 60 demounted from the liquid inlet 52 is placed on the plug member-placing structure 491. This reduces the likelihood that the periphery is stained with ink. According to the above embodiment, the protrusion 494 as the sealing part-mounting portion is inserted into the recess 629 of the first seal portion 622, so that the plug member 60 is placed on the plug member-placing structure 491 (shown in FIG. 7). This configuration enables the plug member 60 to be stably placed on the protrusion 494.

According to the above embodiment, the plug member-placing structure 491 is located on the opposite side to the visible portion 445 across the liquid inlet 52 (shown in FIG. 3). This configuration reduces the likelihood that the plug member 60 moves towards the visible portion 445 in the course of demounting the plug member 60 from the liquid inlet 52 and placing the plug member 60 on the plug member-placing structure 491 (in the course of the user's operation). This configuration accordingly reduces the likelihood that the ink adhering to the plug member 60 drops down to the visible portion 445 to stain the visible portion 445 and the identification surface 502.

According to the above embodiment, the mounted part 64 has the length L that is shorter than the shortest length DL from the mounting structure 495 to the visible portion 445 in the state that the mounted part 64 is attached to the mounting structure 495 (shown in FIGS. 3 and 8). This configuration reduces the likelihood that the visible portion 445 and the identification surface 502 are stained with ink when the plug member 60 is demounted from the liquid inlet 52. For example, even when the user demounts the plug member 60 from the liquid inlet 52 and mistakenly moves the plug member 60 toward the visible portion 445, this configuration prevents the plug member 60 from reaching the visible portion 445. This accordingly reduces the likelihood that the visible portion 445 and the identification surface 502 are stained with the ink adhering to the plug member 60.

B. Other Embodiments

Figure 9:
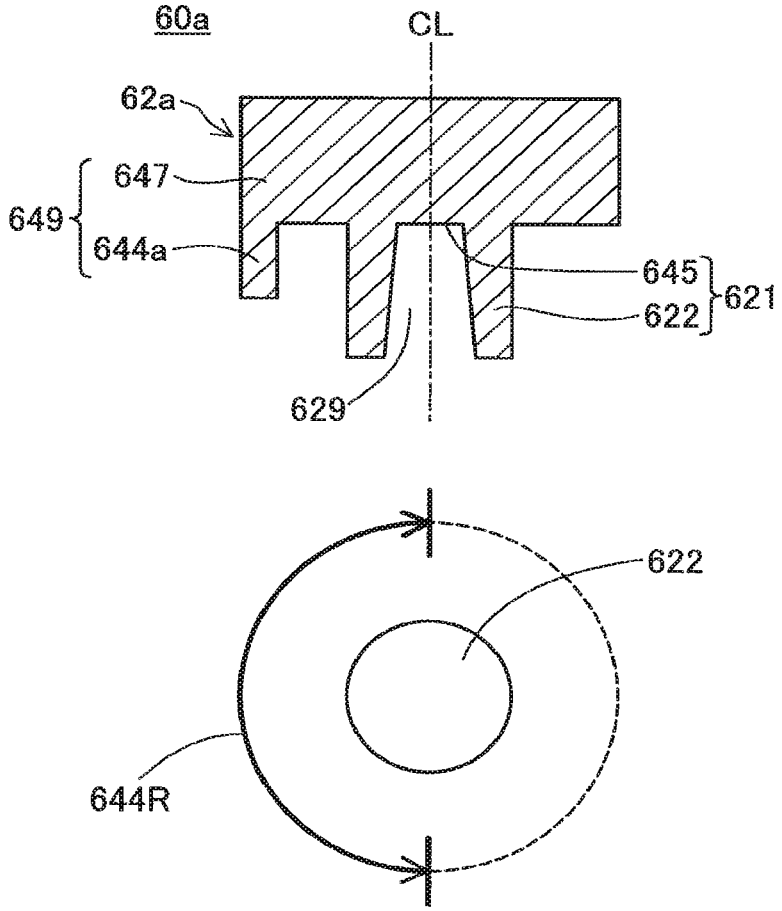
FIG. 9 is a diagram illustrating a plug member according to another embodiment.
Figure 10:
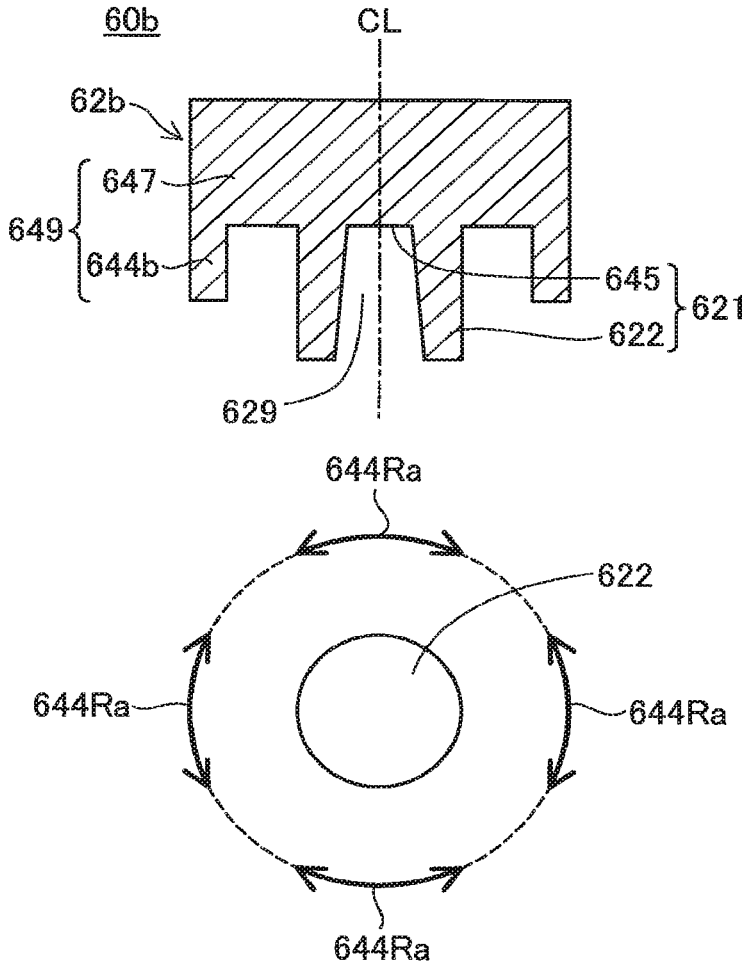
FIG. 10 is a diagram illustrating a plug member according to another embodiment.

FIG. 9 is a diagram illustrating a plug member 60*a* according to another embodiment. FIG. 10 is a diagram illustrating a plug member 60*b* according to another embodiment. The upper drawings of FIGS. 9 and 10 respectively show sections of the plug members 60*a* and 60*b*. The lower drawings of FIGS. 9 and 10 respectively show ranges where cover main bodies 644*a* and 644*b* are located. The plug members 60*a* and 60*b* differ from the plug member 60 of the first embodiment (shown in FIGS. 5 and 6) by the shape of the cover main bodies 644*a* and 644*b*. The other configurations of the plug members 60*a* and 60*b* are similar to that of the plug member 60. The like components are expressed by the like symbols and are not specifically described. In FIGS. 9 and 10, the mounted part 64 (shown in FIG. 6) is omitted from the illustration. Like the plug member 60 of the first embodiment, the plug member 60*a* or 60*b* is detachably mounted to the liquid inlet 52 to close the liquid inlet 52.

The cover main body 644*a* of the plug member 60*a* (shown in FIG. 9) is arranged around part of the circumference of the first seal portion 622. More specifically, the cover main body 644*a* is formed to have a hemispherical section perpendicular to an axial line CL and is disposed in a range 644R to cover half the circumference of the first seal portion 622. The cover main body 644*b* of the plug member 60*b* (shown in FIG. 10) is arranged around part of the circumference of the first seal portion 622. More specifically, the cover main body 644*b* is comprised of four arc-shaped members formed to have concentric sections perpendicular to an axis line CL. The respective members of the cover main body 644*b* are disposed in ranges 644Ra that are arranged around the circumference of the first seal portion 622 to be away from one another by predetermined intervals in the circumferential direction. The plug members 60*a* and 60*b* of these embodiments have the similar configurations to that of the first embodiment described above and accordingly exert the similar advantageous effects to those of the first embodiment. For example, when the first seal portion 622 is pulled out from inside of the liquid inlet 52 and the plug member 60*a* or 60*b* is demounted from the liquid inlet 52, the cover part 649 serves as the barrier. This reduces the likelihood that the ink adhering to the sealing part 621 is splashed around to the outer side of the cover part 649. In the plug members 60*a* and 60*b* of the embodiments shown in FIGS. 9 and 10, the cover main body 644*a* or 644*b* is not placed along the entire circumference of the first seal portion 622. In the state that the plug member 60*a* or 60*b* is mounted to the liquid inlet 52, this configuration allows for checking whether the first seal portion 622 is certainly inserted into the liquid inlet 52 through the remaining areas (clearances) other than the areas where the cover main body 644*a* or 644*b* is placed.

Figure 11:
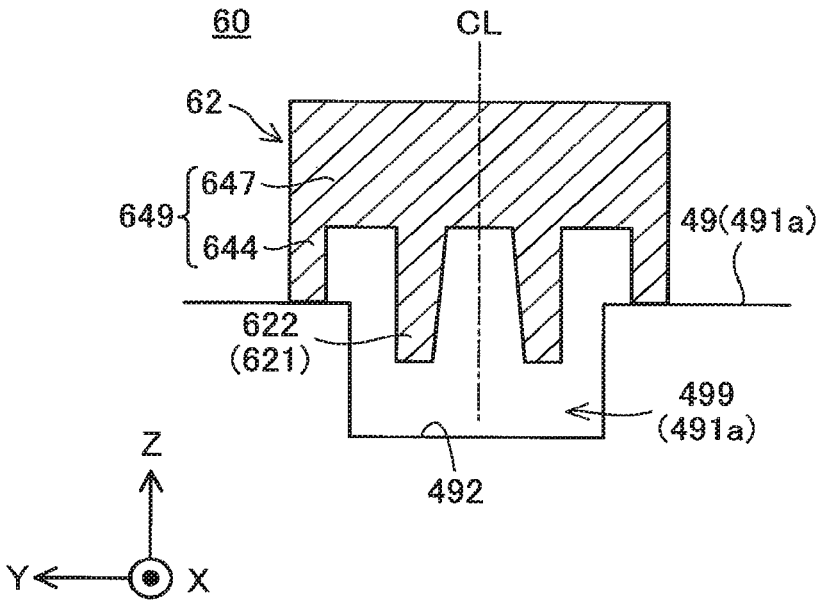
FIG. 11 is a diagram illustrating a plug member-placing structure according to another embodiment.

FIG. 11 is a diagram illustrating a plug member-placing structure 491*a* according to another embodiment. FIG. 11 is a sectional view corresponding to FIG. 7. The plug member-placing structure 491*a* has a different configuration from that of the plug member-placing structure 491 of the first embodiment (shown in FIG. 7). The other configuration of this embodiment is similar to the configuration of the first embodiment. The like components are expressed by the like symbols and are not specifically described. The plug member-placing structure 491*a* includes a second upper surface 49 as a first surface which the cover part 649 (more specifically, the cover main body 644) is placed on and a receiving portion 499 formed in a concave shape to receive the sealing part 621 therein. In other words, the receiving portion 499 is a recess formed in the second upper surface 49. The receiving portion 499 has a bottom face 492 that is located at the lower position than the second upper surface 49.

As shown in FIG. 11, when the plug member 60 is placed on the plug member-placing structure 491*a*, the configuration of the plug member-placing structure 491*a* prevents the cover part 649 from coming into contact with the bottom face 492 and thereby reduces the likelihood that ink adheres to the cover part 649.

Figure 12A:
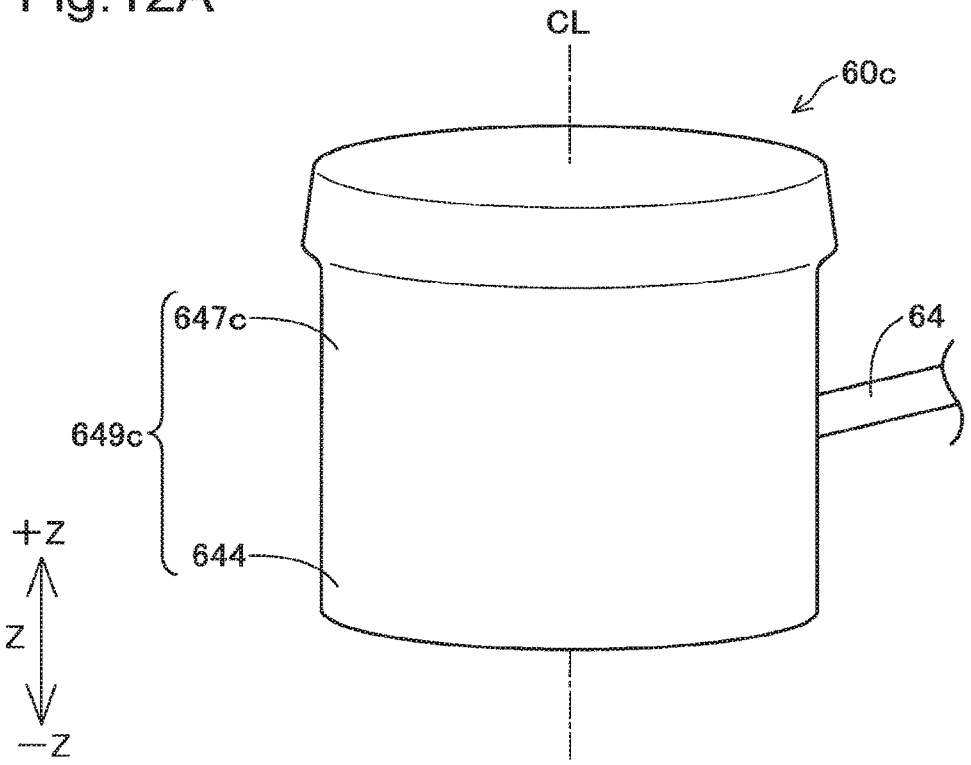
FIG. 12A is a diagram illustrating a plug member according to another embodiment.
Figure 12B:
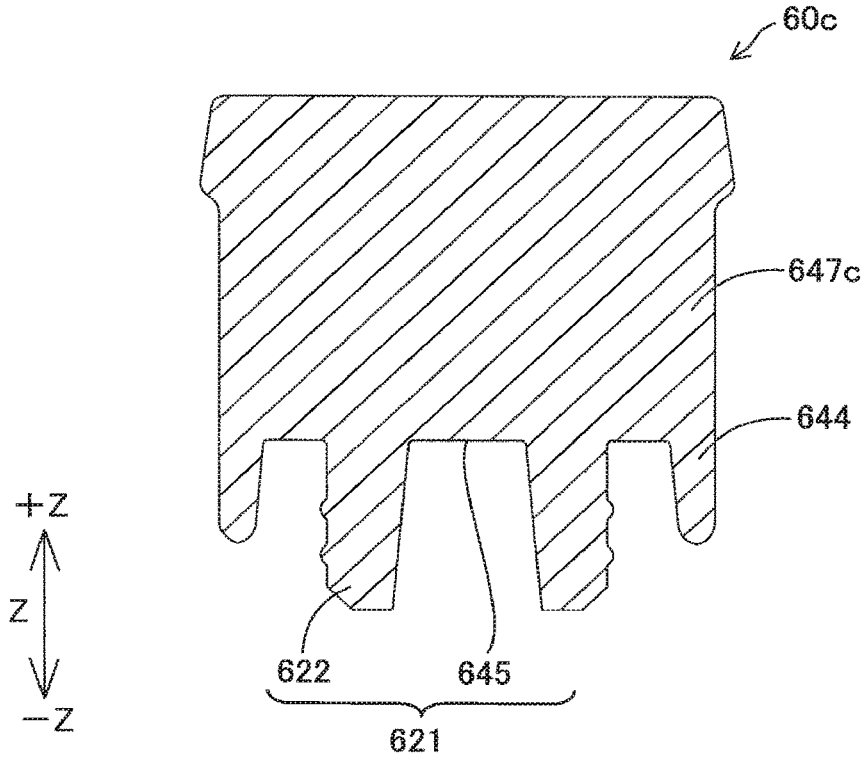
FIG. 12B is a diagram illustrating the plug member according to another embodiment.

FIGS. 12A and 12B are diagrams illustrating a plug member 60*c* according to another embodiment. More specifically, FIG. 12A illustrates the appearance of the plug member 60*c*. FIG. 12B illustrates a section of the plug member 60*c* that goes through an axial line CL of the plug member 60*c* and is parallel to the axial line CL. The plug member 60*c* differs from the plug member 60 of the first embodiment (shown in FIGS. 5 and 6) by the shape of a grip portion 647*c* of a cover part 649*c*. The other configuration of the plug member 60*c* is similar to that of the plug member 60. The like components are expressed by the like symbols and are not specifically described. The mounted part 64 is only partly shown in FIG. 12A and is omitted from the illustration of FIG. 12B. As shown in FIGS. 12A and 12B, the cover part 649*c* includes a circular cover main body 644 that is arranged around the sealing part 621 and a grip portion 647*c* in a cylindrical form that is connected with an opposite end of the cover main body 644 opposite to the mounting direction (−Z-axis direction). The cover main body 644 is connected with the grip portion 647*c* by a continuous surface without any step. The plug member 60*c* is produced by integral molding of a resin material like the first embodiment. The configuration of the plug member 60*c* shown in FIG. 12 enables the user to readily mount and demount the plug member 60*c* to and from the liquid inlet 52 by simply gripping the grip portion 647*c* of the cylindrical form.

Figure 13A:
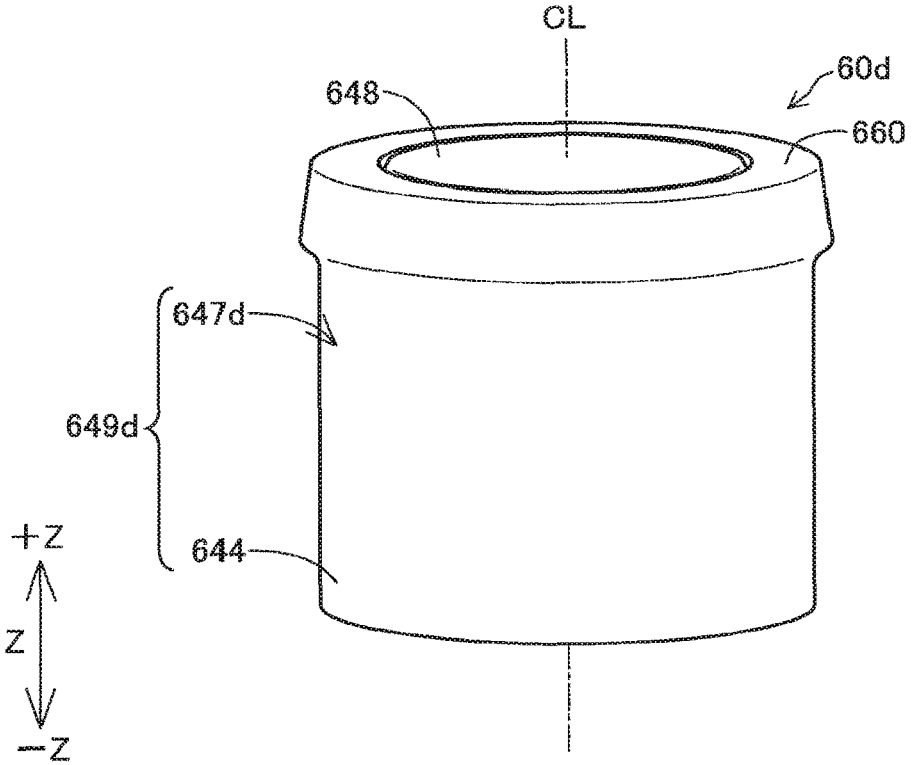
FIG. 13A is a diagram illustrating a plug member according to another embodiment.
Figure 13B:
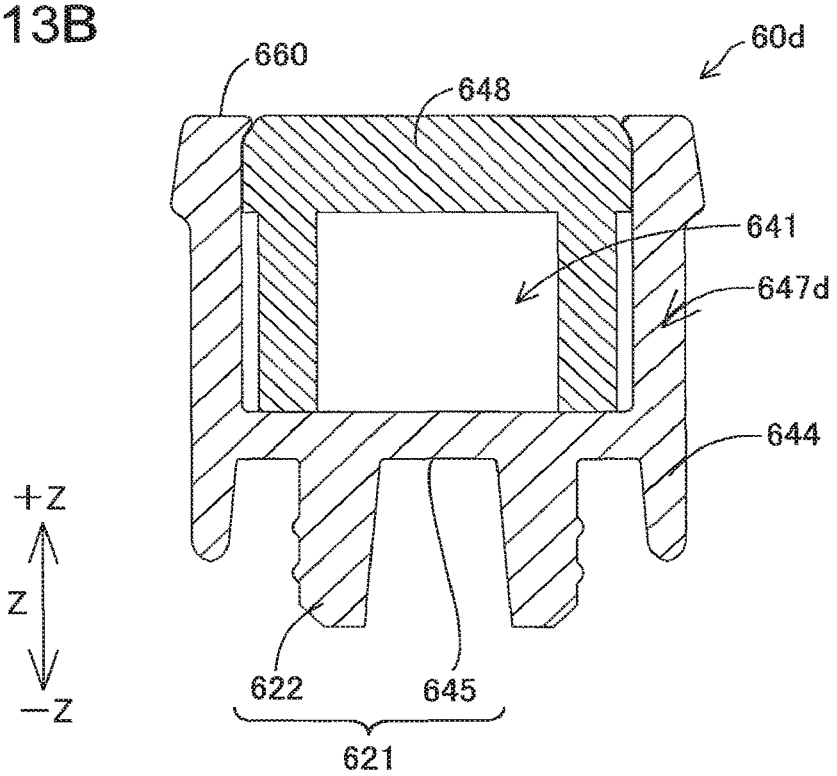
FIG. 13B is a diagram illustrating the plug member according to another embodiment.

FIGS. 13A and 13B are diagrams illustrating a plug member 60*d* according to another embodiment. More specifically, FIG. 13A illustrates the appearance of the plug member 60*d*. FIG. 13B illustrates a section of the plug member 60*d* that goes through an axial line CL of the plug member 60*d* and is parallel to the axial line CL. The plug member 60*d* differs from the plug member 60*c* shown in FIGS. 12A and 12B by the shape of a grip portion 647*d* of a cover part 649*d*. The other configuration of the plug member 60*d* is similar to that of the plug member 60*c*. The like components are expressed by the like symbols and are not specifically described. The mounted part 64 is omitted from the illustration of FIGS. 13A and 13B. As shown in FIG. 13B, the grip portion 647*d* includes a recess 641 and an identification portion 648. The recess 641 is provided on a grip portion end portion 660 of the grip portion 647*d* opposite to the mounting direction (−Z-axis direction). The recess 641 is open in the direction opposite to the mounting direction. The identification portion 648 is placed in the recess 641 to be in contact with the inner circumferential surface of the recess 641 on the grip portion end portion 660-side. The identification portion 648 is used to identify the type of ink contained in the liquid container assembly 50. According to this embodiment, the identification portion 648 is painted with a color corresponding to the color of ink contained in the liquid container assembly 50. This configuration reduces the likelihood that the plug member 60*d* is mistakenly mounted to the liquid inlet 52 of the liquid container assembly 50 provided to contain a different type of ink. The identification portion 648 is not limited to this configuration but may have a portion in which the color of ink contained in the liquid container assembly 50 is written by a letter string. The identification portion 648 may be used to identify the type of ink such as pigment ink or dye ink, instead of being used to identify the color of ink. The first seal portion 622, the cover main body 644 and the components defining and forming the recess 641 of the plug member 60*d* are formed by integral molding of a resin material. The identification portion 648 is made of a material (for example, resin material) having the higher hardness than those of the first seal portion 622 and the like. This configuration enables the user to more readily grip the grip portion 647*d*. The hardness herein denotes the degree of hardness of each component and is measured by a durometer hardness test in conformity with JIS K6253.

Figure 14:
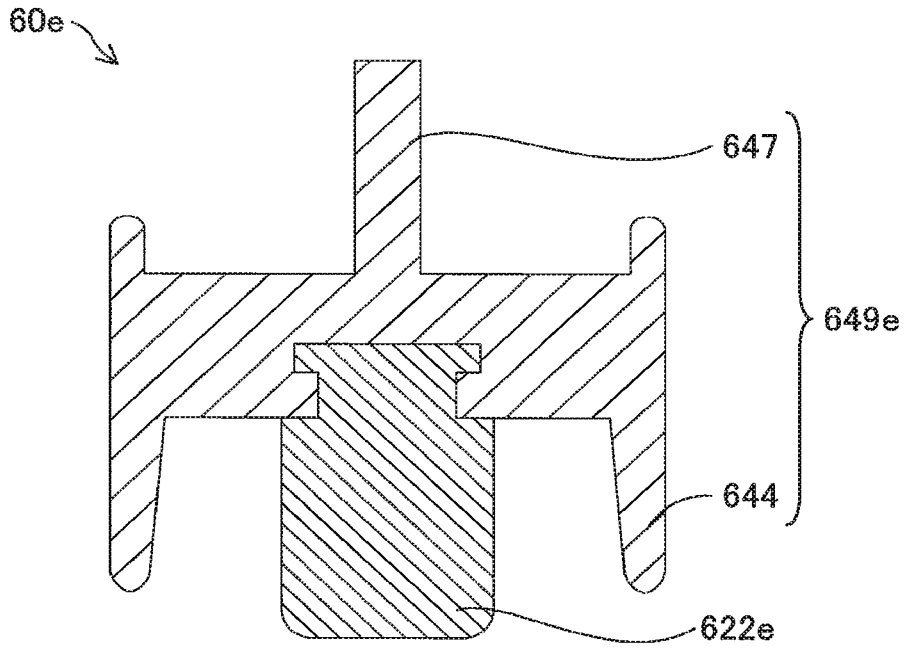
FIG. 14 is a diagram illustrating a plug member according to another embodiment.

FIG. 14 is a diagram illustrating a plug member 60*e* according to another embodiment. FIG. 14 illustrates the plug member 60*e* in a section parallel to the X-axis direction and the Z-axis direction (XZ section) with regard to the XYZ axes shown in FIG. 7. The plug member 60*e* differs from the plug member 60 of the first embodiment (shown in FIGS. 5 and 6) by that a first seal portion 622*e* is in a cylindrical form and has the functions of the second seal portion 645 (shown in FIG. 6) and that the first seal portion 622*e* and a cover part 649*e* are formed from different members. The other configuration of the plug member 60*e* is similar to that of the plug member 60. The like components are expressed by the like symbols and are not specifically described. The mounted part 64 is omitted from the illustration of FIG. 14. A grip portion 647 is in a plate-like form like the grip portion 647 of the first embodiment (shown in FIG. 5). The first seal portion 622*e* is in a cylindrical form. The first seal portion 622*e* is inserted into the liquid inlet 52. The inner circumferential surface of the liquid inlet 52 is air-tightly in contact with an outer circumferential surface of the first seal portion 622*e*. The cover main body 644 and the grip portion 647 are formed by integral molding of a resin material. The first seal portion 622*e* is molded from a different type of resin material from the resin material of the cover main body 644 and the grip portion 647. The plug member 60*e* including the cover main body 644, the grip portion 647 and the first seal portion 622*e* may be formed by, for example, two-color molding. The first seal portion 622*e* is made of a material having the lower hardness than that of the cover part 649*e*. The first seal portion 622*e* is elastically deformed to be in contact with the liquid inlet 52 at the higher air resistance. This configuration is, however, not restrictive, but another embodiment may have any configuration that the cover part 649*e* and the first seal portion 622*e* as the sealing part are formed from materials having different degrees of hardness. For example, the first seal portion 622*e* may be formed from a material having the higher hardness than that of the cover part 649*e*. The first seal portion 622*e* and the cover part 649*e* are made to have different degrees of hardness, so that the plug member 60*e* may be designed adequately according to the applications of the respective components 622*e* and 649*e*.

C. Modifications

The invention is not limited to any of the embodiments and the examples described above but may be implemented by a diversity of other aspects without departing from the scope of the invention. Some of possible modifications are given below.

C-1. Modification 1

According to the above embodiments, the plug member-placing structure 491 (491*a*) (shown in FIG. 4 or FIG. 11) is formed to have a concave portion. This configuration is, however, not essential, but the plug member-placing structure 491 may have any configuration that allows the plug member 60 to be detachably mounted to. For example, the plug member-placing structure 491 may be formed in a convex shape, may be a screw attachable to the case upper surface 41, or may be a snap-fit. In an application using a screw to place the plug member 60-60*b*, a hole which the screw is inserted through may be provided in the plug member 60. In an application using a snap-fit to place the plug member 60-60*b*, a structure to be engaged with the snap-fit may be provided in the plug member 60.

C-2. Modification 2

In the above embodiment, as shown in FIGS. 5 and 6, the sealing part 621 includes the first seal portion 622 in the tubular form and the second seal portion 645 arranged to close one end opening of the first seal portion 622. This configuration is, however, not restrictive, but the sealing part 621 may have any configuration that is inserted into the liquid inlet 52 to close the liquid inlet 52. For example, the sealing part 621 may be a columnar member (for example, cylindrical form) that is inserted (pressed) into the liquid inlet 52. In the above embodiment, as shown in FIGS. 5 and 6, the cover part 649 has the grip portion 647. The cover part 649 may, however, be configured without the grip portion 647. The shape of the grip portion 647 is not limited to any of the above embodiments but may be any holdable shape. For example, the grip portion 647 may be a projection in a cylindrical form. As shown in FIG. 5, FIG. 9 or FIG. 10, the sectional shape of the cover main body 644, 644*a* or 644*b* of the cover part 649 perpendicular to the axial line CL is the circular shape or the arc shape concentric with the circular outer shape of the first seal portion 622. This configuration is, however, not restrictive. For example, the cover main body 644 may have a rectangular sectional shape or an elliptical sectional shape.

C-3. Modification 3

Figure 15:
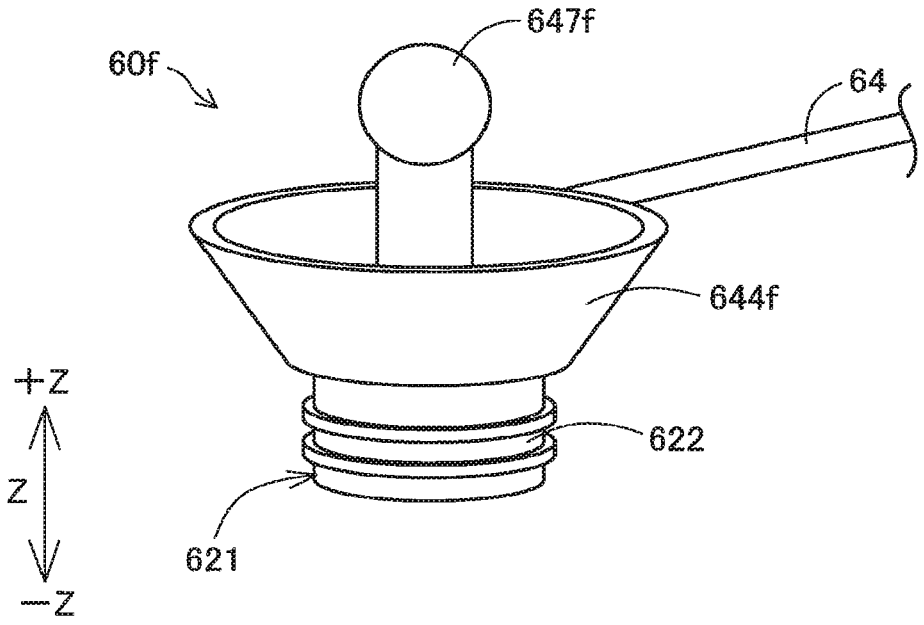
FIG. 15 is a diagram illustrating a plug member according to a modification.

FIG. 15 is a diagram illustrating a plug member 60*f* according to a modification. The plug member 60*f* differs from the plug member 60 of the first embodiment (shown in FIGS. 5 and 6) by the configuration of a cover main body 644*f* and a grip portion 647*f*. The other configuration of the plug member 60*f* is similar to that of the plug member 60. The like components are expressed by the like symbols and are not specifically described. The mounted part 64 is only partly shown in FIG. 15.

The grip portion 647*f* is connected with an opposite end portion of the sealing part 621 opposite to the mounting direction (−Z-axis direction). The grip portion 647*f* is a cylindrical member extended along the mounting direction. The cover main body 644*f* is arranged to surround at least a first seal portion 622-side end of the grip portion 647*f*. The cover main body 644*f* is in a concave shape that is open on the +Z-axis direction side. According to this modification, the plug member 60*f* has the cover main body 644*f*. This configuration reduces the likelihood that the user directly touches the liquid inlet 52 in the process of mounting and demounting the plug member 60*f* to and from the liquid inlet 52.

C-4. Modification 4

The case 40 and the liquid container assemblies 50 are placed outside of the housing 12 according to the above embodiments, but may be placed inside of the housing 12. In the latter case, it is preferable that part of the housing 12 may be configured to be openable and closable to make the case 40 and the liquid container assemblies 50 accessible from outside. Another modification may provide a cover to cover the case 40 and the housing 12 shown in FIG. 1. The case 40 may have any configuration that covers at least part of the liquid container assemblies 50. Additionally, according to another modification, the liquid container unit 30 may be placed inside of the printer 10 to constitute part of the printer 10.

C-5. Modification 5

In the embodiments and modifications described above, the plug members 60 to 60*f* are used to close the liquid inlet 52 of the liquid container assembly 50. The plug member may, however, be used to block a liquid inlet of a liquid container assembly configured to contain a liquid other than ink (for example, resin solution). The liquid container assembly configured to contain another liquid may be used in any of the following liquid ejection apparatuses:

(1) image recording apparatus, such as a facsimile machine;

(2) color material ejection apparatus used to manufacture color filters for an image display apparatus, e.g., a liquid crystal display;

(3) electrode material ejection apparatus used to form electrodes of, for example, an organic EL (electroluminescence) display and a field emission display (FED);

(4) liquid ejection apparatus configured to eject a bioorganic material-containing liquid used for manufacturing biochips;

(5) sample ejection apparatus used as a precision pipette;

(6) ejection apparatus of lubricating oil;

(7) ejection apparatus of a resin solution;

(8) liquid ejection apparatus for pinpoint consumption of lubricating oil on precision machines such as watches or cameras;

(9) liquid ejection apparatus configured to eject a transparent resin solution, such as an ultraviolet curable resin solution, onto a substrate in order to manufacture a hemispherical microlens (optical lens) used for, for example, optical communication elements;

(10) liquid ejection apparatus configured to eject an acidic or alkaline etching solution in order to etch a substrate or the like; and

(11) liquid ejection apparatus equipped with a liquid ejection head for ejecting a very small volume of droplets of any other liquid.

The "droplet" herein means the state of liquid ejected from the liquid ejection recording apparatus or the liquid ejection apparatus and may be in a granular shape, a teardrop shape or a tapered threadlike shape. The "liquid" herein may be any material ejectable by the liquid ejection recording apparatus or the liquid ejection apparatus. The "liquid" may be any material in the liquid phase. For example, liquid-state materials of high viscosity or low viscosity, sols, aqueous gels and other liquid-state materials including inorganic solvents, organic solvents, solutions, liquid resins and liquid metals (metal melts) are included in the "liquid". The "liquid" is not limited to the liquid state as one of the three states of matter but includes solutions, dispersions and mixtures of the functional solid material particles, such as pigment particles or metal particles, solved in, dispersed in or mixed with a solvent. Typical examples of the liquid include ink described in the above embodiment and liquid crystal. The ink herein includes general water-based inks and oil-based inks, as well as various liquid compositions, such as gel inks and hot-melt inks. In an application using a liquid chamber configured to contain UV ink curable by UV radiation and connected with the printer, the arrangement of the liquid container coming off the placement surface reduces the likelihood that the UV ink is cured by transmission of heat from the placement surface to the liquid chamber.

What is claimed is:

1. An ink tank having an ink inlet, comprising:

a plug member that is detachably mounted to the ink inlet to close the ink inlet, the plug member including:

a seal portion configured to be inserted into the ink inlet;

a circular projection provided on the seal portion to close the ink inlet when the seal portion is inserted in the ink inlet;

a cylindrical cover body connected to the seal portion; and a grip portion connected to the cylindrical cover body, the grip portion having at least two surfaces that are opposite to each other, are substantially parallel to a diameter of the cylindrical cover body, and that extend in a direction intersecting with a mounting direction of the plug member.

2. The ink tank according to claim 1, wherein the plug member further includes a mounted part projecting from the cylindrical cover body.

3. The ink jet printing system according to claim 1, further comprising a plug member mounting structure, wherein the plug member further includes a mounted part configured to be mounted to the plug member mounting structure.

4. The ink jet printing system according to claim 3, wherein the plug member mounting structure is located at a higher position than the ink inlet.

5. The ink jet printing system according to claim 4, wherein the ink tank has an ink identification surface arranged vertically at a lower position than the ink inlet and configured to make the ink level in the ink tank identifiable from outside.

6. An ink jet printing system comprising:

an ink tank having an ink inlet; and a plug member that is detachably mounted to the ink inlet to close the ink inlet, the plug member including:

a seal portion configured to be inserted in the ink inlet;

a circular projection provided on the seal portion to close the ink inlet when the seal portion is inserted in the ink inlet;

a cylindrical cover body connected to the seal portion; and a grip portion connected to the cylindrical cover body, the grip portion having at least two surfaces that are opposite to each other, are substantially parallel to a diameter of the cylindrical cover body, and that extend in a direction intersecting with a mounting direction of the plug member.

7. The ink jet printing system according to claim 6, further comprising a cover member configured to be openable and closable, wherein the cover member in a closing position covers the ink inlet.

* * * * *